US006102781A

United States Patent [19]

Greathouse et al.

[11] Patent Number: 6,102,781

[45] **Date of Patent: *Aug. 15, 2000**

[54] AUTOMATICALLY SECURABLE TRAVEL LIMITING STOPS FOR PRESSURE SHOES USED IN AN ABRASIVE FINISHING MACHINE

[75] Inventors: Chester Greathouse; Leroy E. Stump, both of Maple Grove; Jerome Emmett Hansen, Anoka, all of Minn.

[73] Assignee: Timesavers, Inc., Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/677,050

[22] Filed: Jul. 9, 1996

Related U.S. Application Data

[63] Continuation-in-part of application No. 08/248,325, May 24, 1994, abandoned.

[51] Int. Cl.[7] ..... B24B 1/00

[52] U.S. Cl. ..... 451/59; 451/296; 451/299; 451/300; 451/303

[58] Field of Search ..... 451/5, 59, 296, 451/299, 300, 303, 365, 406, 914

[56] References Cited

U.S. PATENT DOCUMENTS

| | | |
|---|---|---|
| 1,618,207 | 2/1927 | Lane . |
| 3,694,966 | 10/1972 | Heesemann . |
| 3,782,044 | 1/1974 | Olin . |
| 3,895,464 | 7/1975 | Kiser . |
| 4,151,705 | 5/1979 | Evans . |
| 4,512,110 | 4/1985 | Stump . |
| 4,569,155 | 2/1986 | Fischer et al. . |
| 4,594,815 | 6/1986 | Mickelson et al. . |
| 4,601,134 | 7/1986 | Heesemann . |
| 4,640,056 | 2/1987 | Stump . |
| 5,094,036 | 3/1992 | Botteghi . |
| 5,220,750 | 6/1993 | Emberland et al. . |

FOREIGN PATENT DOCUMENTS

| | | |
|---|---|---|
| 8103445 | 2/1983 | Netherlands . |
| PCT/US80 01678 | 1/1982 | WIPO . |

*Primary Examiner*—David A. Scherbel
*Assistant Examiner*—Derris Holt Banks
*Attorney, Agent, or Firm*—Patula & Associates

[57] ABSTRACT

An improved method and device for performing setup and adjustment of pressure shoes used in an abrasive finishing machine. The setup of the pressure shoe stop limit device is performed automatically and remotely. The stop limit is hydraulically locked in place and limits subsequent shoe rotation. This automatically positionable travel limit stop takes into account the natural spring of the various machine components, including the innate springiness of the surfacing head elastic covering which wears and deforms over time. The pressure shoe is adjusted relative to the surfacing head, and accounts for the undefinable characteristics of the overall machine.

19 Claims, 12 Drawing Sheets

AUTOMATICALLY SECURABLE TRAVEL LIMITING STOPS FOR PRESSURE SHOES USED IN AN ABRASIVE FINISHING MACHINE

CROSS-REFERENCE TO RELATED APPLICATION

The present application constitutes a continuation-in-part of application Ser. No. 08/248,325, filed May 24, 1994, now abandoned, and entitled "AUTOMATICALLY SECURABLE TRAVEL LIMITING STOPS FOR PRESSURE SHOES USED IN AN ABRASIVE FINISHING MACHINE" now abandoned.

I. FIELD OF THE INVENTION

The present invention is generally related to a workpiece dimensioning and finishing machine utilizing, with orbiting endless belts traversing abrasive heads, and with the workpiece finishing machine being provided with means for controllably positioning, and for controllably working the surface of the workpiece to the desired finish. These positioning means may include at least one resettably adjustable pressure shoe and/or pinch roller for reproducibly and uniformly applying a clamping force to a workpiece while being exposed to the working forces of the abrasive head, along with a control system which monitors the performance of each of the abrasive heads for controlling the treatment of the work. Through exercise of control within each of the work stations on an intra-station and inter-station basis, the positioning means provides a proper and generally optimum balancing of the actual effort or work undertaken at each individual one of the multiple number of adjacent stations. In this fashion, the surface finishes created on workpieces as they are delivered at the outfeed end are more consistent, one to another, and machine performance is enhanced through significant extension of working abrasive belt life. Additionally, the surface finish on each of the workpieces delivered from each one of a series of multiple adjacent work stations will have what may be characterized as a "qualified scratch pattern" on its surface. By definition, a "qualified scratch pattern" is one which can be effectively removed in the next succeeding work station, wherein it is replaced with a finer "qualified scratch" which may be effectively removed in a still succeeding work station and replaced in its entirety with a finer "qualified scratch". In each instance, if the scratch pattern created at the previous head has not been removed in its entirety, then the resulting scratch pattern will include that pattern created at the current head, as well as that portion not removed from the scratch pattern created at the previous head. The present system is arranged to provide for effective removal and replacement of grit scratches in order that a workpiece be free of grit scratches created from heads other than the final head or working station in the system. When any multiple-head machine is not properly set and maintained, grit scratches from multiple heads or working stations may be present in the ultimate workpiece.

More particularly, one aspect of the present invention relates to an abrasive belt sanding system which includes machine setup including pressure shoes and/or rollers which are readily and accurately adjustable to a pre-set known point relative to the top surface of a traveling or moving conveyor. This feature provides for precise machine adjustment; the adjustment being within a range to accommodate workpieces traveling along the conveyor and having typical thickness dimensions falling within normal tolerances. In accordance with this aspect of the present invention, pressure shoes are yieldably biased against the workpiece, with the force applied by the shoe against the surface of the workpiece being substantially constant, thereby providing for dimensional consistency and uniformity in the finished workpieces. This arrangement also provides a substantially automatic system creating precise, accurate, and repeatable setup of the travel-limiting or travel-controlling stops which control the position of the shoes and/or rolls so that adjustment is achieved without requiring extensive personal and/or mechanical intervention.

II. BACKGROUND OF THE INVENTION

A. The Pressure Shoe Feature

Finishing machines utilizing abrasive heads, such as wide-belt sanding machines, knife planers, molding heads, shapers and rotary shaping tools normally include pivotally adjustable pressure shoes mounted in opposed relationship to the surface of the conveyor belt and adjacent the finishing head along both the infeed and outfeed sides of the head. Pressure shoes in general are well known in the prior art, with examples of two such devices being disclosed in U.S. Pat. No. 3,782,044 to Olin and U.S. Pat. No. 4,594,815 to Mickelson et al, each of which is assigned to the same assignee as the present invention, and with the disclosures of each being incorporated herein by reference. In wide-belt abrasive sanding and finishing machines, one or more working heads are typically provided. Each head typically comprises an endless abrasive belt trained about two or more drums or rollers, with one or more of the drums being power driven and with the others normally being idlers. The ends of the drums have axially positioned concentric shafts which extend outwardly from the ends and which are typically journaled and mounted for rotation within the frame of the apparatus. The drums typically have parallelly disposed axes which are adapted for appropriate adjustment of position, with one drum typically being arranged to control belt trackings.

In operation of these finishing machines, workpieces are normally fed into the machine and carried to the work station along the upper flight of a horizontally disposed endless belt conveyor. The abrasive heads are positioned in spaced relationship to the top surface of the conveyor belt so as to form one or more working stations along the length of the belt. While abrasive heads are normally positioned to come into contact and treat the top surface of the workpiece, they are sometimes positioned to come into contact with and treat the bottom surface of the workpiece as well. Bottom-head machines require pressure shoes the same as top-head machines, it being understood, therefore, that the disclosure of operation of top-head machines is exemplary only.

Workpieces arrive at the machine with a certain randomness of thickness dimension. Considering the dimensional tolerances involved, and considering further the value of the workpieces at this stage of their processing, it becomes important for the apparatus to create a working balance between each of the individual sequentially positioned work stations so as to ensure that each of the individual abrasive belts will be operating so as to treat the workpiece so as to replace the qualified scratch created at the prior station with a finer qualified scratch which may be effectively treated at the next succeeding station. Additionally, the individual abrasive belts will be operating within the working parameters of the working grit or mineral which it carries on its surface. Furthermore, it will be appreciated that the apparatus must be capable for use with a variety of woods, varying from soft to hard, and with each variety possessing individual abrading or mechanical response properties. It is, therefore, important to provide an apparatus which is capable of responding to the individual requirements and needs of the various woods involved, while permitting effective use of the apparatus with each of these different wood varieties so as to replace an incoming qualified scratch pattern with an outgoing and finer qualified scratch pattern.

The conveyor belt assembly may be typically vertically adjustable either toward or away from the abrasive belt assemblies. In certain machines, the conveyor belt may be designed so as to provide a floating bed arrangement, it being understood that the system of the present invention is adaptable for use in combination with either types of assemblies. One adjustable conveyor which may be utilized with wide-belt sanding apparatus of the present invention are disclosed in U.S. Pat. No. 3,832,808, and reference is made to the disclosure in that patent for the details of such an adjustable conveyor design.

The automatic setup system or feature of the present invention is arranged to provide for substantially automatic adjustment of the machine so that, following the initial setup operation, finished workpieces of consistent finish and uniform thickness will be produced. The arrangement of the present invention is further designed to compensate for any springiness in the machine, thereby achieving greater consistency and uniformity in thickness of the finished workpieces.

As indicated above, in a typical abrasive surface treatment machine, the upper span or flight of the conveyor belt cooperates with a series of pressure shoes or pinch rollers which press the workpieces against the conveyor belt while the workpieces are being fed through the working station of the machine. These pressure shoes or rollers are adjustably positioned relative to a plane parallel to and generally tangent to the work contacting surface of the heads. These pressure shoes or pinch rollers are pivotally mounted to control the path of the workpiece as it enters, passes through, and exits the working zone defined beneath the work contacting surface of the surfacing head. When properly set and adjusted, these devices assure smooth and consistent feeding of the workpiece through the machining process and assist in achieving a smooth and consistent surface on the workpiece. If the pressure shoes or pinch rolls are positioned where excessive force is applied, passage of the workpiece is restricted and marks or blemishes may be produced on the surface of the workpiece or the workpiece may be stopped entirely. If the adjustment of the pressure shoes is such that insufficient force is being applied, the workpiece may either hesitate or move intermittently, thereby producing a rippled or washboard-like surface due to inconsistent motion, with the shoes having little effect on machine operation. A feature of the arrangement of the present invention has been found to enhance the consistency of force adjustment for the pressure shoes, thereby enhancing control of workpiece motion and accordingly the quality and consistency of the surface of the finished workpiece.

In the past, pressure shoes and/or rollers have been provided with travel limiting stops, typically comprised of either a rigid system or a modestly flexible system with only limited motion possible. A typical rigid system is disclosed in U.S. Pat. No. 3,782,044 to Olin. Such a rigid system may simply include a bolt that passes freely through a bracket and is threaded into the upper portion of the shoe. Lock nuts secure the bolt in a rigid position to secure the shoe against loss of adjustment. In a system which provides for flexible mounting of the shoe with limited travel, a spring or pneumatic device may be implemented to provide a mechanical bias with yieldable travel. In the latter machines, the machine operator typically accomplishes the setup operation by what is known in the art as "feel". In this arrangement, the operator simply moves a workpiece through the machine and compares the magnitude of the "drag" which he senses manually against that of a standard setup spool or gauge. (See FIG. 4). In this manner, the pressure shoe or roller is adjustably positioned relative to a plane which is tangent to the apex point or workpiece engaging surface of the abrasive head positioned above and in spaced relationship to the load bearing surface of the conveyor belt.

One anomaly of drum-head wide belt sanders is that the surface of the drum is typically provided with a layer of rubber or other resilient material which deforms and deflects during the abrasive finishing process. The magnitude of deformation is in direct response to the downward forces involved in the specific abrasive operation. The deflection of the resilient material (typically rubber) and the characteristic springiness of the overall machine are parameters which cannot be measured and given an absolute value. These undefinable parameters make the setup process subject to a certain amount of guesswork, and accordingly require evaluation of empirical data gathered through trial and error operations. As a result, a pressure shoe or roller may be set a few thousandths of an inch higher or lower than the apex of the surfacing head based on empirical evaluations, the success of which are subject to the training, experience and skill level of the setup person. The empirical evaluation process normally requires several independent tests in order to permit the setup person to make those numerous slight adjustments which lead to desired results. The time needed depends upon the accuracy required and also upon the specific results desired. Accordingly, accurate, and repeatable machine setup is difficult to perform, and the setup operation is frequently labor-intensive and time-consuming.

As an additional complicating factor, as the abrasive surface of the abrasive belt or other surfacing head wears, the space or gap between the apex of the surfacing head and the conveyor belt surface is subject to change. Thus, periodic readjustment of the pressure shoe or roller have typically been required in order to consistently maintain the desired spaced relationship between a plane extending tangent to the apex of the surfacing head and the plane of the working surface of the pressure shoes. While initial setups have normally been performed by positioning the pressure shoe relative to the abrasive surfacing head, subsequent readjustment to accommodate for wear is usually performed by adjustably positioning the abrasive surfacing head relative to the working surface of the pressure shoe or pinch roll. Such setup operations and readjustment operations have similarly been undertaken with machines having abrasive heads other than widebelt sanders, such as knife planers or the like.

The data created from the making of such adjustments is gathered, and transferred to a memory bank such as a microprocessor. Additional data, including power requirements for the operation of individual heads, the varieties of wood being treated, the thickness of workpieces exiting each work station, and thickness measurements and tolerances for incoming workpieces are representative of other data which is to be included in the processor. Such data is useful in the proper positioning of the shoes as well as the individual abrasive surfacing heads, including the drum head wide belt sanders. Thus, the system maintains stock removal at the optimum level so as to completely replace the scratch pattern created at the abrasive head in the prior work station.

Excessive stock removal reduces the abrasive belt life and causes excessive loading of the drive, resulting in a requirement for more frequent adjustments than otherwise would be necessary. When an insufficient amount of stock is removed, the head may fail to completely replace the scratch pattern created from the abrasive head in the prior work station.

Accordingly, the head in each work station removes only the amount of stock needed to remove the scratch pattern produced at the prior work station, replacing it with a scratch pattern from the current head. By way of example, at one station, a #36 grit scratch pattern is removed by replacing it with a #50 grit scratch pattern. At the next succeeding station, the #50 grit scratch pattern is removed, and replaced with a #100 grit scratch pattern, etc. In multiple station systems, each grit in the sequence is finer than its predecessor, it being understood that as the grit becomes smaller in size, its capability of stock removal decreases. Thus, multiple stations are required in order to achieve an appropriate and acceptable surface finish on the workpiece.

B. Head Positioning and Drive Control

In another aspect of the present invention, a multiple head machine is designed with tandemly or serially arranged working stations, with three such stations in a single machine being typical. Each station is equipped with a working abrading head carrying a continuously moving endless orbiting belt which is positioned for surface contact with the surface of the work along drum apex line. In such an arrangement, the particle size of the grit or mineral on the abrading belt used in each of the stations decreases from station-to-station, starting with coarse grit, continuing with a medium grit, and finishing with a fine grit. By way of example, a series of abrading heads may utilize belts having grits starting with an initial coarse grit of #36 at the first head, then proceeding to a less coarse or medium grit of #50 at the second head, and finally utilizing a fine grit of #100 at the third head. Other grit arrangements may be employed, it simply being noted that each head will be equipped with a finer grit than its predecessor station in order to achieve the desired finish. Because of the inter-relationship of the stations operating with specific grits, the setup for the individual working stations must be such as to cause a predictable and controllable amount of abrasion to occur at each station for creation of a qualified scratch pattern at each station. The abrasion occurring in each station must be within the established working parameters of the individual minerals or grits, and must also be capable of producing only those qualified scratch patterns which are capable of being removed in succeeding stations. For example, the stock removal undertaken in the first working station must be within the working parameters of the equipment, including all of its components and the abrasive grit on the belt. The workpiece forming the output from the first working station is determined and subsequent work stations are adjustably positioned in order to accommodate the individual workpiece through the creation of a qualified scratch pattern. In other words, there must be enough thickness available in the workpiece to permit controlled removal at each station so as to both prepare the workpiece and place it in a condition to receive scratch removal treatment at subsequent stations. In a conventional machine, if the initial coarse or stock removal station removes an excessive amount of material from the workpiece, the second station may not be capable of adjustment or repositioning to contact or otherwise effectively treat the surface of the workpiece for full removal of the scratch pattern created at the initial or preceding station. For example, a #100 grit cannot effectively remove a scratch pattern created by an abrading belt carrying a #36 grit. The end result is a finished product being delivered at the outfeed which may be unacceptable for use in fine furniture or cabinetry.

SUMMARY OF THE INVENTION

In accordance with the present invention, therefore, means are provided to adjustably position pressure shoes, pinch rollers and working heads so that a substantially constant and proper working force is available at each component of the working station, while permitting these components including the shoes and working heads to be adjustably positioned in response to modest differences in the thickness of workpieces without significantly altering the unit pressures being applied by the components including the pressure shoes and other devices as they are positioned against the surface of the workpieces.

Additionally, the arrangement of the present invention provides for ease of setup and subsequent automatic adjustments for proper running of the machine, with the setup and subsequent operation being designed to be accomplished with minimal operator involvement and input, and without requiring extensive preliminary measurements in order to satisfy the operational parameters desired. In this fashion, the rolls and shoes are capable of automatic precise adjustment, with the measurements being obtained on individual workpieces leaving each work station providing a precise indication of the exact adjustments necessary for the abrasive drum. In other words, the arrangement of the present invention permits the initial setup operation as well as subsequent operational readjustments without requiring manual intervention for physically repositioning the components, including pressure shoes, pinch rolls, or other components during a given production run.

It is accordingly a principle object of the present invention to provide an abrasive surfacing machine with means for automatic initial setup of the pressure shoe, and for subsequent readjustment without requiring a setup person to physically adjust the pressure shoes or rolls in order to maintain the optimum operating parameters of the process.

It is a further object of the present invention to provide an abrasive surfacing machine or apparatus and method of operating such a machine where the pressure shoes or rollers are readily adjustable and not set to a fixed position relative to other machine components, and wherein the heads may be adjustably positioned relative to other heads in a serially arranged group of heads.

It is yet a further object of the present invention to provide an abrasive surfacing machine or apparatus having an improved pressure shoe arrangement which compensates for the natural operational dynamics such as machine deflection due to the spring of certain machine components, along with other undefinable anomalies which are not susceptible of determination or measurement.

An additional object of the present invention is to provide an improved wide belt sander apparatus which allows the operator to perform setup and/or adjustment of components at any time through the working operation and with immediate, reliable, predictable, and repeatable results.

Yet another object of the present invention is to provide for an improved apparatus which allows the operator to remotely and accurately perform the setup process and to maintain consistent machine performance through automatic readjustment.

Other objects, features and advantages of the present invention will become apparent to those skilled in the art through a detailed reading of the description of the preferred embodiment, claims, and drawings herein wherein like numerals refer to like elements.

A. The Pressure Shoe Feature

The foregoing objects and advantages of the present invention are achieved by providing, in one aspect of the invention, an abrasive surfacing machine having pressure shoes which can be selectively positioned for operation so as to be urged against a workpiece under a substantially constant force under predetermined deflection. This apparatus and method allows an operator to remotely prepare or otherwise set up the apparatus for use, while providing immediate response with reliable, predictable, and repeatable results. The arrangement takes into account the undefinable anomalies of the machine, which to date, could neither be anticipated nor accurately predicted in a typical setup process. The present apparatus takes into account the natural or dynamic spring of the various machine components during operation, and also takes into account the gradual wear of the surfacing head and the resiliency of the coating applied to the peripheral surface of the head.

More specifically, the surfacing machine of the present invention comprises a main frame with one or more workpiece finishing stations within the frame. Each workpiece finishing station comprises a guiding mechanism for receiving and guiding at least one endless abrasive belt traveling about a predetermined orbit or path. As is typical, the belt guiding mechanism includes a number of spaced cylindrical drums with the endless abrasive belt trained thereabout. The cylindrical drums are of predetermined length and journaled along parallelly disposed axes, with one of the cylindrical drums being driven. This workpiece finishing station comprises a platen head, a drum head, or alternatively, a knife planer or the like.

At least one workpiece hold-down, including a pressure shoe or pinch roll is adjustably and pivotally coupled to the frame and positioned adjacent the working station. Normally, such hold-down device or pressure shoes are operatively positioned at both the infeed side and outfeed side of the working station. Pressure shoes apply a downward pressure to the workpiece as it is carried through the working station on the conveyor. A biasing mechanism controllably urges the hold-down device against the workpiece as it passes through the working station. In an adjustable shoe, a stop-limit device coupled to the frame serves to limit the rocking movement of the pressure shoe as it contacts the workpiece. A controller coupled to the stop-limit device facilitates selective positioning or adjustment of the stop-limit device. A locking mechanism secures the stop limit mechanism and pressure shoe in place after adjustment by the controller. The controller is operatively coupled to but positioned remote from the locking mechanism for locking the stop-limit mechanism in place. Thus, the pressure shoe can be quickly, accurately and selectively setup to accommodate a particular workpiece.

One of the key features of the present invention is that the apparatus can be initially setup to handle a specific operation, and components in each station may be subsequently readjusted while the operation is underway, to take into account the unpredictable and undefinable deflection of the surfacing head, including its elastic or resilient covering, and the characteristic springiness of the overall machine. The present invention provides for a setup process which eliminates guess-work, and trial-and-error determinations. By way of example, this setup procedure includes initially urging the pressure shoe against a piece of setup material in response to a pre-set force, and then locking the travel limit stop and pressure shoe into place. In certain instances, the pressure shoe may be retracted to clear the workpiece before entering the working station. When the pressure shoe is urged against the workpiece, it is biased to resist rotation away from the setup position by the travel limiting stop. If over-sized workpieces enter the work station, deflection of the pressure shoe may occur without significantly increasing the magnitude of the force being applied by the shoe against the work. Readjustment of the apparatus may be undertaken at any time in order to compensate for wear or erosion of the abrasive on the surfacing head, and these readjustment procedures may be performed by an operator remote from the surfacing head.

The pressure shoe typically has a generally "L"-shaped body with a lower work-contacting surface and an upper end. The stop limit device is preferably a hydraulically lockable clamp, and includes an axially positionable and selectively extendable piston member operatively coupled to the clamp. The piston member is normally passive, but may be adjustably positioned during the setup procedure, while the pressure shoe is being urged against the surface of a piece of setup material by a predetermined force. While the stop-limit device is in this configuration, the piston member is hydraulically locked in placed, thus fixing the position of the pressure shoe. The pressure shoe is normally restrained from pivotal motion away from the workpiece by a pneumatically filled air-bag, thus providing resilient cushioning of the pressure shoe. In certain applications, a more rigid hold-down device or pressure shoe is desired, and this may be accomplished by having a first predetermined pressure in the airbag for setup, and a second and significantly higher pressure in the airbag during operation. Such an arrangement effectively makes the pressure shoe appear rigid during operation.

An optical sensor is preferably provided for detecting the approach or arrival of each workpiece entering the working station, and upon detection of a signal, the pressure shoe pivotally retracts to a position where its work contacting surface is out-of-contact with the workpiece. Following a predetermined time delay, the pressure shoe is then rotated into contact with the workpiece and remains in contact position until after the workpiece has cleared the working station.

Each work station is preferably provided with a gauge to determine the outfeed workpiece thickness. Such a gauge effectively determines the amount of stock removal in each station, along with an indication of the elevation or position of the working abrasive in the next succeeding station or stations. Through this arrangement, consistent qualified scratch patterns are created, with the final or ultimate station producing the desired finish.

In an alternative preferred embodiment of the pressure shoe feature, the travel stop limit device may comprise a rotatable cam mounted on a shaft passing through the machine frame and with the cam lobe being positioned in an opening formed in the upper end of the pressure shoe. This cam arrangement may be adjusted by mechanical or hydraulic rotation to selectively establish the maximum stroke for movement of the pressure shoe from its original setup position. The extent of the stroke motion is determined by the travel limiting stop. This apparatus may also be readjusted at any time by an operator stationed remote from the surfacing head. In still yet another alternative preferred embodiment, the pressure shoe is provided with a notch formed in the upper end thereof. A locking protrusion or wedge is operatively coupled to the frame, and may be selectively inserted into this notch during the setup procedure to restrict pivotal motion of the pressure shoe with respect to the workpiece.

The preferred setup method for these embodiments of the pressure shoe feature comprises the steps of first advancing a workpiece into the working station and below the pressure shoe. Next, the pressure shoe is lowered onto the workpiece using the pneumatic biasing mechanism, and providing a predetermined force creating a downward pressure against the workpiece. The position of the stop limit device is adjusted using the adjustment mechanism, and is preferably simultaneously adjusted as the pressure shoe is being rotated. The stop limit device is positioned to restrict further pivoting of the pressure shoe, and the stop limit device is locked in place.

DESCRIPTION OF THE PREFERRED EMBODIMENT

Figure 1:
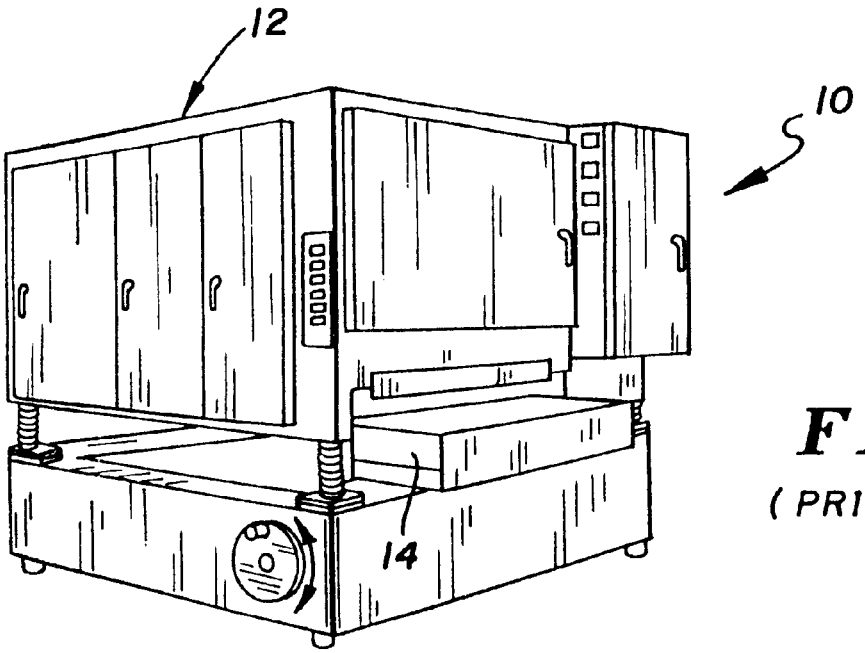
FIG. 1 (PRIOR ART)
FIG. 1 is a perspective view of a typical abrasive finishing machine.
Figure 2:
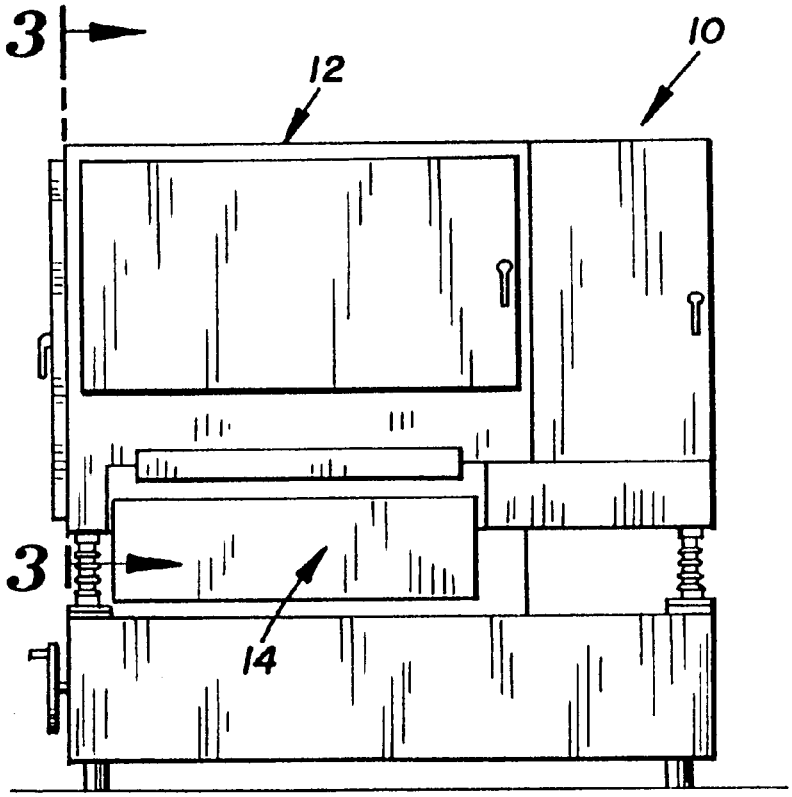
FIG. 2 (PRIOR ART)
FIG. 2 is a front elevational view of a typical abrasive finishing machine.
Figure 3:
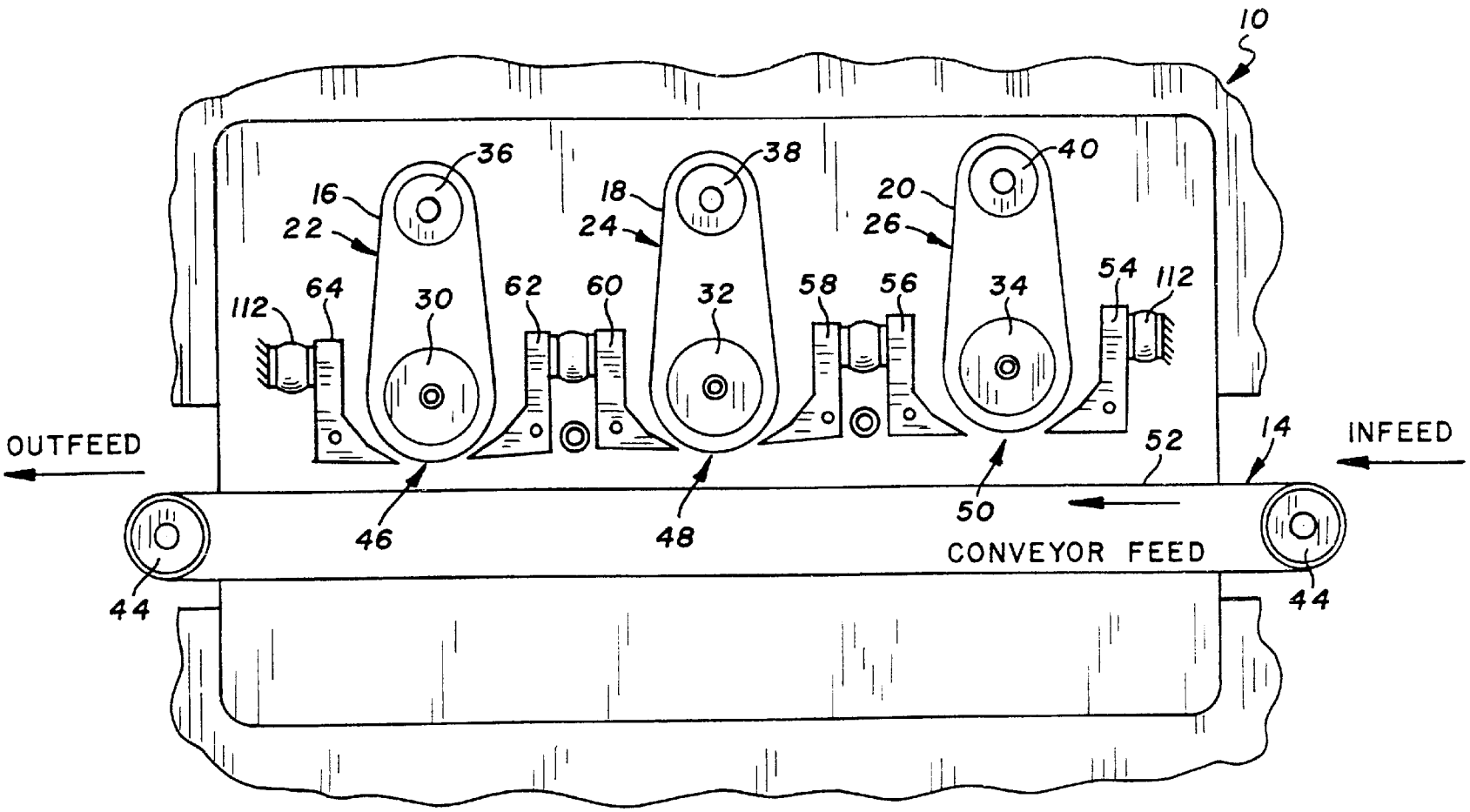
FIG. 3 (PRIOR ART)
FIG. 3 is an end view taken along line 3—3 of FIG. 2 of a typical abrasive finishing machine, without the frame, illustrating a typical head and pressure shoe setup.

Referring to FIGS. 1–3, a typical abrasive finishing machine 10 capable of utilizing the features of the present invention is shown. Machine 10 has a frame structure 12 preferably in the form of a rigid rectangular structure, such as a weldment, for supporting a work-carrying conveyor 14, and further including means such as drums or cylinders for receiving, guiding and driving at least one wide endless abrasive belt about a predetermined path. A plurality of abrasive belts 16, 18, and 20, shown in FIG. 3, are typical endless wide belts having an outer abrasive coated surface. Such belts are, of course, in common use and commercially available. FIG. 3 shows a machine with three drum head systems 22, 24 and 26, each of which utilizes one endless abrasive belt. Such heads are similar to those disclosed in U.S. Pat. No. 4,512,110 to Stump, and U.S. Pat. No. 5,220,750 to Emberland et al., both patents being assigned to the same assignee as the present invention. The endless abrasive belts 16, 18, and 20 are each trained about two individual drums or rollers, specifically, main drive rollers 30, 32, 34, and the idler rollers 36, 38 and 40. Each drive roller is driven by a separate motor (not shown) to drivably advance the respective abrasive belt trained about the respective pair of rollers.

Conveyor 14 is provided to support workpieces as they move through the apparatus and into contact with the wide abrasive belts 16, 18 and 20. Conveyor 14 includes a belt having an upper span or flight upon which the workpieces are carried. The path of the belt is controlled by conveyor rollers 44. Such conveyor systems typically include a conveyor belt supporting pad beneath the working station and are well known in the art.

Three working stations identified at 46, 48 and 50 are defined by the zones between the respective abrasive belts and the upper surface 52 of conveyor 14. As workpieces are advanced by conveyor 14 into each of the working stations or working zones shown at 46, 48 and 50, the upper surface of the workpiece is in operative contact with, and opposed to, the abrasive coated outer surface of the endless abrasive belts 16, 18 and 20. In this fashion, the surface of the workpiece is treated, abraded, and/or sanded to its desired dimension and surface finish. While conventional drum heads are shown at 22, 24 and 26 in FIG. 3, it is to be recognized that orbital heads, combination heads, knife planer heads, or platen head systems could be used in place of any or all these basic drum heads to achieve a desired treatment. For purposes of illustration, drum heads are shown and have been described so far to facilitate an understanding of the present invention as it is adapted for use with this machine.

The Pressure Shoe Feature

Individual pairs of pivotally mounted pressure shoes are shown, one shoe on each side of each surfacing head. These pressure shoes are designated 54, 56, 58, 60, 62 and 64. However, alternative hold-down devices such as pinch rolls could be used in place of any or all of these pressure shoes if desired. These pressure shoes control the advance and also constrain the movement of the workpiece as it enters, passes through, and exits the respective working zones of the surfacing heads 22, 24 and 26. These pressure shoes will, if properly set and adjusted, assure a smooth advance, resulting in repeatable finishing of each of the workpieces. It is known that improper setting or adjustment of pressure shoes in abrasive head machines may produce marks, patterns, or other defects on the workpiece through improper motion control, such as a rippled or washboard appearance. The present invention reduces these problems by maintaining the force exerted by the pressure shoes within an appropriate window which is sufficiently high to maintain smooth advance of the workpieces, but is not excessive so as to produce marks or patterns on the workpiece surfaces.

The incoming or workpiece-engaging tip of pressure shoe 54 is usually set slightly lower than the apex of drum head 26 to allow for variations in incoming workpiece thicknesses and to assure that any part which contacts the abrasive is under the control of the shoe. Trailing pressure shoes 56 and 58 are normally set to the apex of incoming head 26. In other words, the tips of both pressure shoes 56 and 58 are spaced above conveyor 14 a dimension determined by the distance that the apex of head 26 is positioned above conveyor 14. Both of pressure shoes 60 and 62 are set to the apex of abrasive head 24. Pressure shoe 64 is set to the apex of abrasive head 22. Accordingly, as each workpiece is advanced by conveyor 14 through machine 10, drum heads 26, 24 and 22 will sequentially treat the workpiece. Pneumatic air bellows 112 positioned between frame 12 and the shoes selectively urge each of the respective shoes against the workpieces, and permit retraction of the shoe as well.

Figure 4:
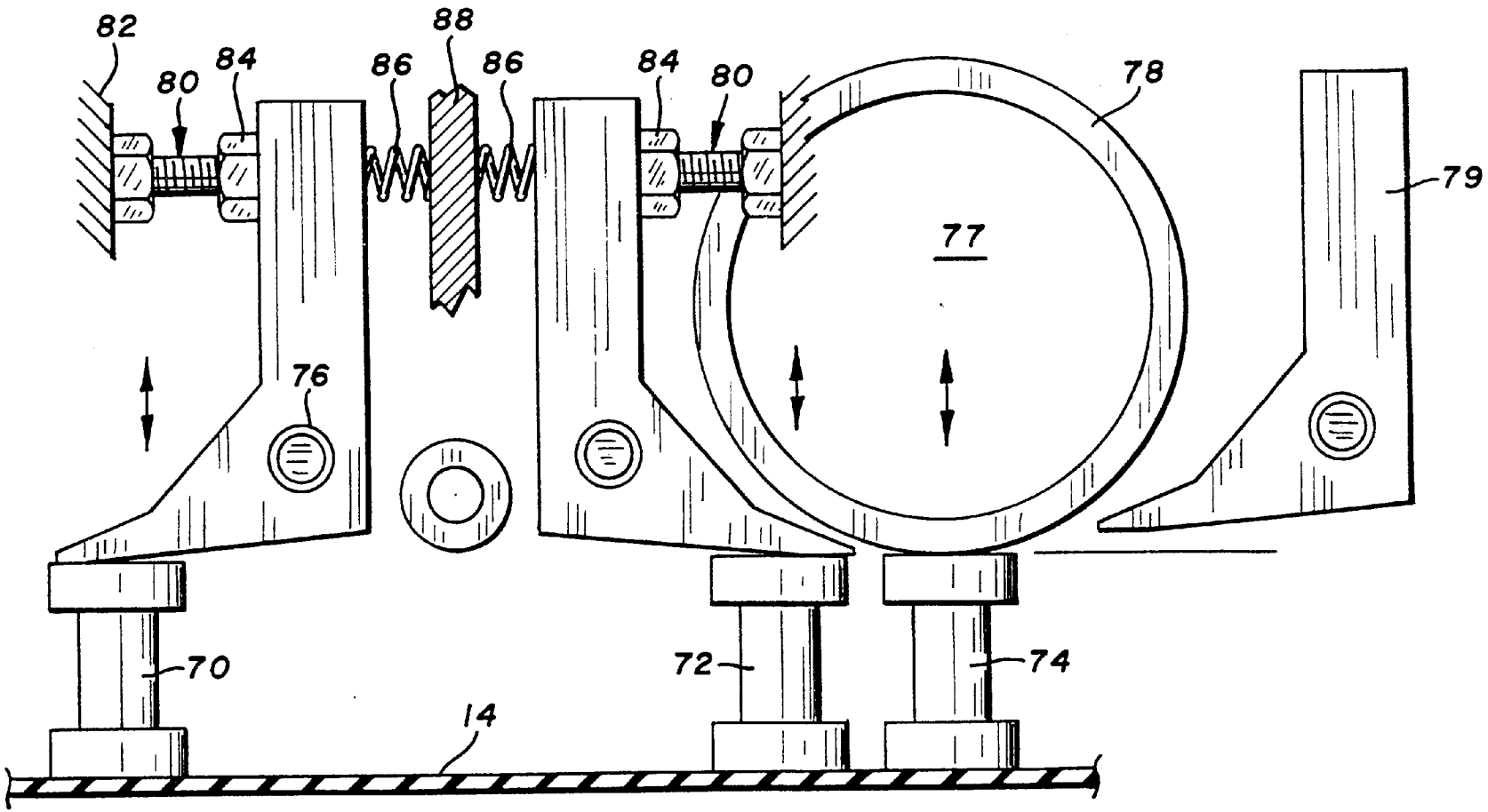
FIG. 4 (PRIOR ART)
FIG. 4 is an exploded view of one abrasive head having one pressure shoe positioned each side thereof, illustrating conventional setup gauges or spools used to set the shoe relative to the apex of the surfacing head and above the conveyor belt.

Referring to FIG. 4, a typical prior art adjustment procedure is shown for setting up and adjusting surfacing heads and pressure shoes having fixed travel limit stops. Setup spools, shown at 70, 72 and 74 are typically used by an experienced setup person to set the relationship between the pressure shoes and surfacing heads, relative to conveyor belt 14. The pressure shoes are typically set by feel by the machine operator, or setup person, who compares the drag against the setup gauge in an attempt to set the pressure shoe relative to the apex of the surfacing head above the conveyor belt 14.

While performing initial setup procedures for the pressure shoes, the operator aligns the pressure shoes to the abrasive heads. Although the operating plane of the abrasive heads may be altered, additional adjustments of the respective shoes may be appropriately accommodated in a manner as set forth below. Similarly, in knife planers, the outfeed pressure shoes are typically adjusted to the apex of the knife head. As the abrasive or cutting surface of the surfacing head wears, the height of the apex of the surfacing head above the conveyor belt changes as well. Thus, readjustment of the pressure shoe is required to maintain a desired relationship. This readjustment has typically been performed by finely adjusting the surfacing head and placing the apex of the cutting surface back into the desired relationship with the adjacent pressure shoes. While the apparatus of the present invention may be designed to accommodate this adjustment essentially automatically, it will be understood that the various features of the present invention may be utilized on either a semi-automatic or more manual basis.

Each abrasive surfacing head, such as represented at 77, typically has an elastic covering 78 (normally Neoprene rubber) which deforms during the abrading process based on the force involved in the specific machining process. Deflection of the elastic covering, and the innate springiness of the overall machine, is undefinable in the current setup process. This makes prior art setup procedures subject to guess work, and trial and error. A pressure shoe, such as represented at 79, may be set a few thousandths of an inch higher or lower than the apex of the surfacing head 77, based on the training, experience, and skill level of the setup person, and the desired result. Accordingly, accurate, repeatable setup of the surfacing head without human intervention has not been possible.

Each of the pressure shoes is pivotally mounted about a respective shaft 76, these shafts extending laterally between, and being coupled to machine frame 12. The degree to which each pressure shoe can rotate and rock downwardly is determined by travel limiting stops, shown at rigid stops 80. These stops could also be comprised of a flexible system, such as a spring device, or a pneumatically operated device. (See FIG. 1). One end of each travel limiting stop 80 is secured to a frame portion 82 which extends laterally between, and is secured to frame 12. The opposing end 84 of each travel limiting stop 80 simply abuts the upper end of the respective pressure shoe when it is pivoted into its lower-most position, as shown. A biasing spring 86 is provided for each pressure shoe, and is connected at one end to a frame member 88, and which extends therefrom and urges against the upper end of the respective shoe. This fixed and rigid travel limiting stop requires manual adjustment every time a setup or adjustment procedure needs to be undertaken. As previously indicated, this setup and adjustment procedure is time consuming and tedious.

Referring back to FIG. 3, the selectively inflatable pneumatic bag or air bellows shown at 112 is used in place of spring 86, to urge the respective pressure shoes into contact with the workpiece. While both air and spring devices have typically been used to urge the respective pressure shoe about the respective shaft 76 and upon the workpiece as it is advanced thereunder, such prior art devices do not serve to lock the pressure shoe into place, nor do they provide a means for automatically and remotely locking a pressure shoe into place following setup or adjustment of the pressure shoes. Another typical prior art rigid travel limiting stop is disclosed in U.S. Pat. No. 3,782,044, which was previously discussed in the background of the invention, and which is assigned to the assignee of the present invention.

Figure 5:
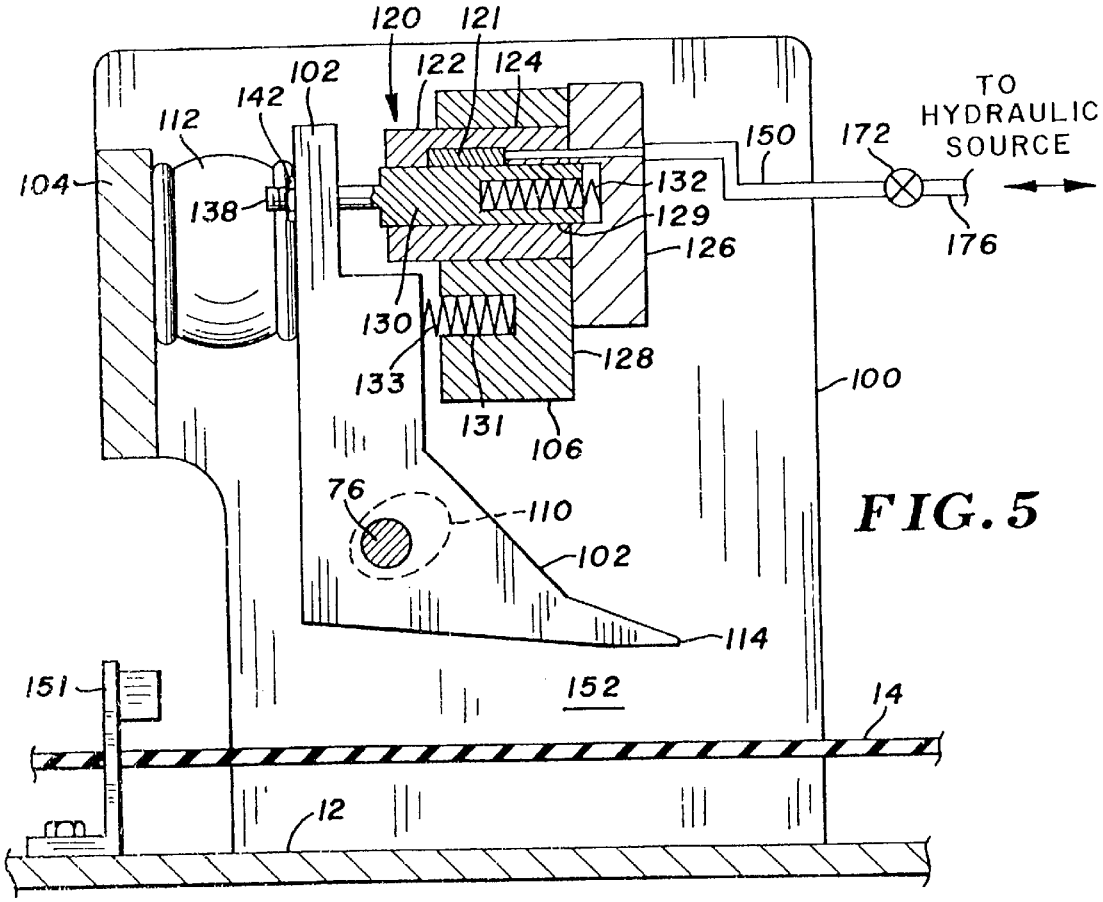
FIG. 5 is a sectional view of a pressure shoe assembly according to the preferred embodiment of the present invention with a hydraulically operated work support used as an adjustable and lockable travel limit stop for the shoe.

Turning now to FIG. 5, an improved automatic, remotely controllable and precisely settable travel limiting stop for pressure shoes is shown generally at 120. This improved travel limiting stop, and method for adjusting the same, allows an operator to perform setup and setup adjustment, automatically, remotely, and without the setup person physically adjusting the pressure shoes in the machine. According to this new method and apparatus, the pressure shoe is not set to a fixed dimension relative to the machine components, but is pneumatically pivoted against the surface of a piece of setup material in response to a substantially constant predetermined force. This allows the natural spring of the various components of the surfacing machine to come to a defined and repeatable state of deflection. At this point, the travel limiting stop, one component of which is operatively coupled to the upper end of the shoe and the other coupled to the frame, is hydraulically locked into place. Specifically, a hydraulically operated mechanical clamp illustrated at 121 is urged against the outer periphery of piston 130. This operation is controlled from an operator's console throughout the manufacturing process, and with immediate, predictable, and repeatable results. (See FIG. 6).

As can be seen in FIG. 5, one of a pair of parallelly disposed, vertically extending, side frame members 100 has been removed to show a profile of a pivoting pressure shoe 102. For purposes of illustration, only one pressure shoe and associated travel limit stop will be described, it being recognized that any or all pressure shoes, pinch rolls or pressure rollers could be provided with devices according to present invention. A rigid frame member or bracket 104 extends laterally between each pair of side frame members 100, and is welded to each frame member. This frame member 104 provides a first leverage point for the respective pressure shoe 102. One rectangular rigid block 106 is welded to the inner surface of each side frame member 100, as shown, and has a width of approximately 2". This block provides a second leverage point.

Shaft 76, as previously discussed, extends laterally between each side frame member 100, parallel with and above conveyor belt 14. Pressure shoe 102 is eccentrically mounted upon and pivotable about the shaft 76. One eccentric cam 110, shown in phantom, is secured to each end of shaft 76, and can be rotated within a circular opening extending through frame member 100 to accomplish an initial setup adjustment and parallel adjustment of each shoe. These eccentrics may be adjusted from time to time to adjust the position of shaft 76 as desired, and consequently shoe 102 at a desired elevation above conveyor belt 14. The automatic setting device further controls the motion and setting of the shoe, as will now be described.

Secured to the upper, rear end of pressure shoe 102 is a pneumatically inflated or controlled bellows 112. One or more of these bellows are provided for the laterally extending shoe 102, each spaced from the next and securingly attached at one end to bracket 104, and with the other end adjacent the upper end of shoe 102, as shown. Bellows 112 is inflated, and deflated to cause automatic pivoting of shoe 102 about shaft 76. This bellows action forces the shoe tip 114 into contact with, or permits retraction from the workpieces being passed thereunder. (See also FIG. 6). Since the volume of bellows 112 is relatively large, modest motion and/or pivotal movement of the pressure shoes will not significantly alter or change the internal pressure and the resultant amount of force being exerted by the bellows against the pressure shoes.

Also attached to the upper end of each pressure shoe 102 is a positioning control 120 for controlling pivotal motion of pressure shoe 102 during operation of the apparatus. Control 120 operates to limit the clockwise pivoting motion of pressure shoe 102 in the embodiment illustrated in FIG. 5. Hydraulically operated clamping device is preferably comprised of a working support manufactured by the Vektek Corporation of Emporia, Kans., Model No. 10-0508-04 which has a support capacity of 2,000 pounds. Additional discussion of this device is disclosed in U.S. Pat. Nos. 4,743,001, and 4,934,672, both assigned to Vektek Corporation, each of which are incorporated herein by reference. These devices are categorized under the Vektor-flo® product line.

Positioning control 120 has a cylinder housing 122 which is mounted within a conforming opening 124 formed in block 106. Positioning control 120 also includes a rectangular housing portion 126 to which cylinder housing 122 is secured. Housing portion 126 is abutted against surface 128 of block 106, opposite from the upper end of pressure shoe 102. A cylindrical bore 129 extends axially through the work support cylindrical housing 122 in which a cylindrical piston 130 is slidingly positioned. An extension spring 132 located internal to piston 130 is biased against an end wall of bore 129. This spring biases piston 130 outwardly therefrom when not hydraulically locked by clamp 121. A retracting spring 133 is positioned within a bore 131 formed in member 106 so as to provide a gentle retracting force against pressure shoe 102 so as to bias it in a counter-clockwise direction against bellows 112. A bolt 138 is slidably inserted in a bore formed in the upper portion of pressure shoe 102, and is held in place by nuts 142—142 provided over bolt shank 138, one on each side of shoe 102. This arrangement retains bolt 138 in contact with pressure shoe 102, while permitting relative adjustment of the position of bolt 138 relative to the pressure shoe to limit counter-clockwise movement of shoe 102. In this arrangement, the nose of the clamping device touches the shoe 102 at its tip through the force of spring 132 so as to bias the clamping device against the shoe and accordingly follow the shoe as it drops onto the workpiece during setup before locking. A Belleville washer 139 may be captured between the surface of shoe 102 and right-hand positioned nut 142 so as to provide a modest amount of compressibility for minute adjustment when piston 130 is locked in place. The minute adjustment permitted by Belleville washer 139, when utilized, is undertaken to assist in maintaining the overall force applied to shoe 102 at a substantially constant level.

During setup and subsequent adjustment procedures, bellows 112 is expanded and controlled to urge the tip 114 of shoe 102 in a clockwise direction toward a setup workpiece being advanced thereunder. Bellows 112 is inflated to a predetermined pressure to urge the shoe against the workpiece, allowing the natural spring and dynamics of the various components of the surfacing machine to come to a defined and repeatable state of deflection. During initial setup, no hydraulic fluid is provided to clamping device 120 such that piston 130 is generally passive and can freely float or slide therewithin in response to bolt 138 where spring 132 gently urges piston 130 against pressure shoe 102, with shoe 102 being pivoted in a clockwise direction by the force exerted upon it by bellows 112. Thereafter, hydraulic fluid under pressure is applied via line 150 to clamping device 120, to clamp or lock piston 130 into its pre-set position by clamp 121. Only after pressure in bellow 112 is raised to a predetermined pressure is hydraulic fluid applied to clamp 121 in clamping device 120 to lock the piston 130, and consequently locking shoe 102 into place with respect to fixed leverage block 106. The clamping device 120, therefore, operates passively when the pneumatic bellows 112 is used to lower or retract pressure shoe 102 about shaft 76. Clamping device 120 locks the pressure shoe into place after the pressure shoe is urged against the workpiece to a predetermined pressure.

An optical sensor 151 is secured to frame 12, and is aimed into the working area 152 under pressure shoe 102. Such optical sensors are commercially available and may be comprised of Part No. SM2A31RL, manufactured by Banner Engineering Corp. of Minneapolis, Minn. This optical device senses the presence (and absence) of the leading edge (and trailing edge) of a workpiece under pressure shoe 102, and informs the controller of the advancing leading edge of a setup board or workpiece so that the setup procedure or adjustment procedure can be initiated. This procedure, as will also be described shortly in reference to FIG. 9, consists of lowering the shoe against the setup board with a predetermined force or pressure, and subsequently locking the piston 130 into place using clamping member 121. After the setup board has moved past the pressure shoe, optical sensor 151 senses its departure. The piston 130, however, having been set, will remain hydraulically locked until another setup procedure is initiated. Bellows 112 is inflated to an extent such that pressure shoe 102 may rotate in a counterclockwise direction, as required, in response to over-sized workpieces present in the working station and permit pressure shoe 102 to move in response to the over-sized thickness of a workpiece thereunder.

Figure 6:
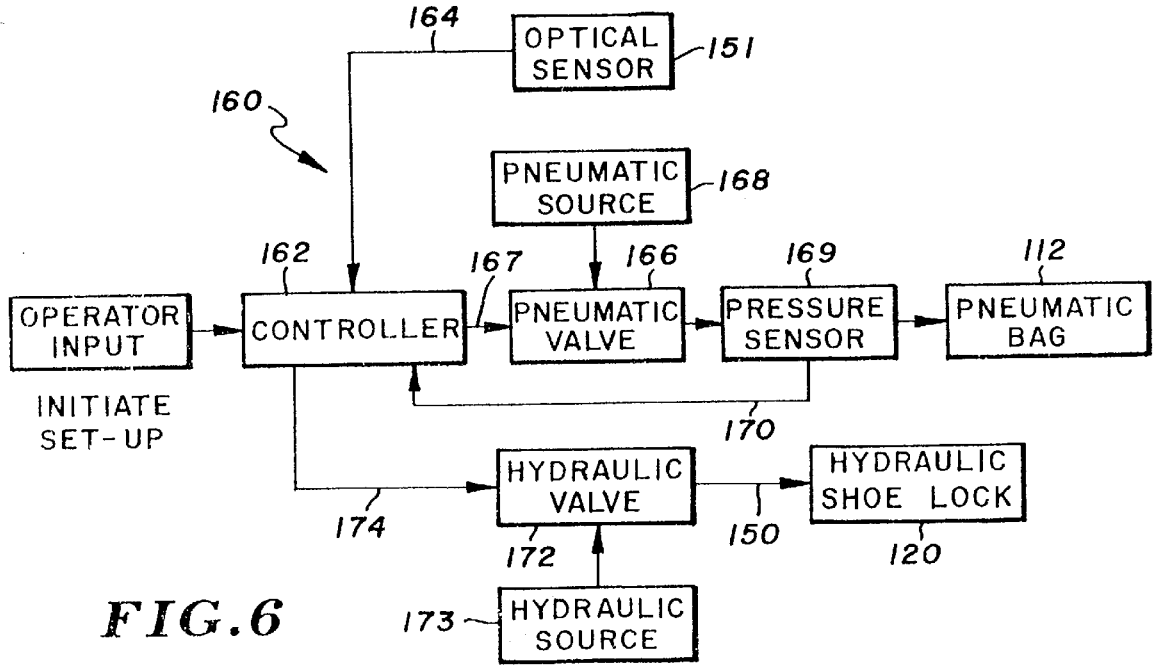
FIG. 6 is a block diagram illustrating the system for controlling the position of the pressure shoe, and for controlling the work support to lock the pressure shoe in place after setup.

Referring to FIG. 6, the system for controlling the shoe apparatus is generally shown at 160. System 160 includes a microprocessor based controller 162 with suitable system software. Controller 162 is responsively connected to sensor 151 via line 164. Controller 162 is also connected to a pneumatic valve 166, this valve being controlled to selectively communicate pneumatic pressure to pneumatic bellows 112. Pneumatic valve 166 is digitally controlled by controller 162 via line 167, and is placed in series between a pneumatic source 168 and each of the pneumatic bellows 112. Controller 162 senses pneumatic pressure in bellows 112 by sensing sensor 169, via line 170, provided in series between valve 166 and bellows 112. Controller 162 precisely controls the internal pressure of bellows 112 by controlling the opening of the valve in view of pressure sensor 169 to, in turn, controllably urge the associated shoe 102 against the working surface of a workpiece.

Controller 162 is shown to control a hydraulic valve 172, this valve being selectively opened to allow hydraulic fluid to flow from hydraulic pressure source 173 to hydraulic locking assembly 120 to lock piston 130 in place. Controller 162 controls hydraulic valve 172 via line 174, wherein hydraulic fluid flows from valve 172 to hydraulic locking device 120 via line segment 150A. The timing for controlling pneumatic valve 166 and hydraulic valve 172 in response to sensor 151 is all controlled by software. To unlock device 120, hydraulic pressure is removed by relieving pressure within line 176.

Figure 7:
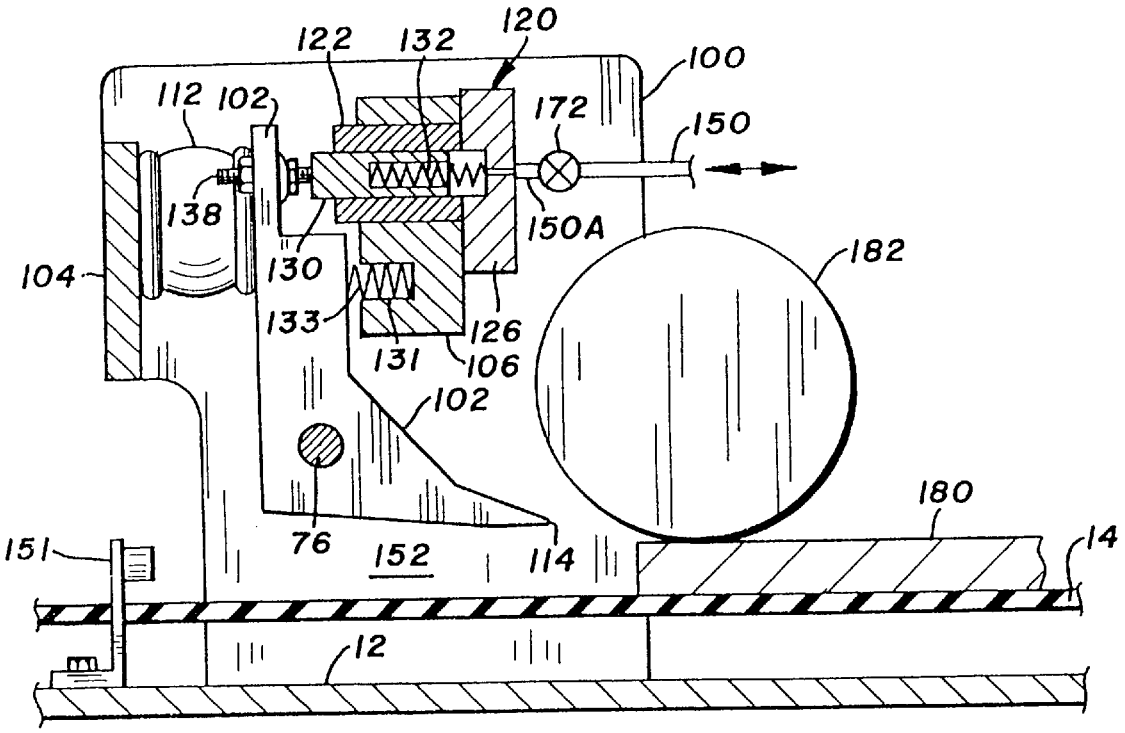
FIG. 7 is an end view of the pressure shoe assembly in a retracted and unlocked position as a workpiece is advanced thereunder.

Referring to FIG. 7, a setup workpiece 180 is shown being advanced by conveyor 14 under a working head 182, and approaching pressure shoe 102. Optical sensor 151 senses that the working area under shoe 102 is still vacant. Accordingly, controller 162 controls pneumatic valve 166 via line 167 so that air bellows 112 deflates and spring 133 retracts shoe 102, as shown. During this stage, piston 130 of locking member 120 is passive, that is, controller 162 insures hydraulic valve 172 is not communicating any hydraulic pressure to locking device 120 such that piston 130 can slide freely with shoe 102.

Figure 8:
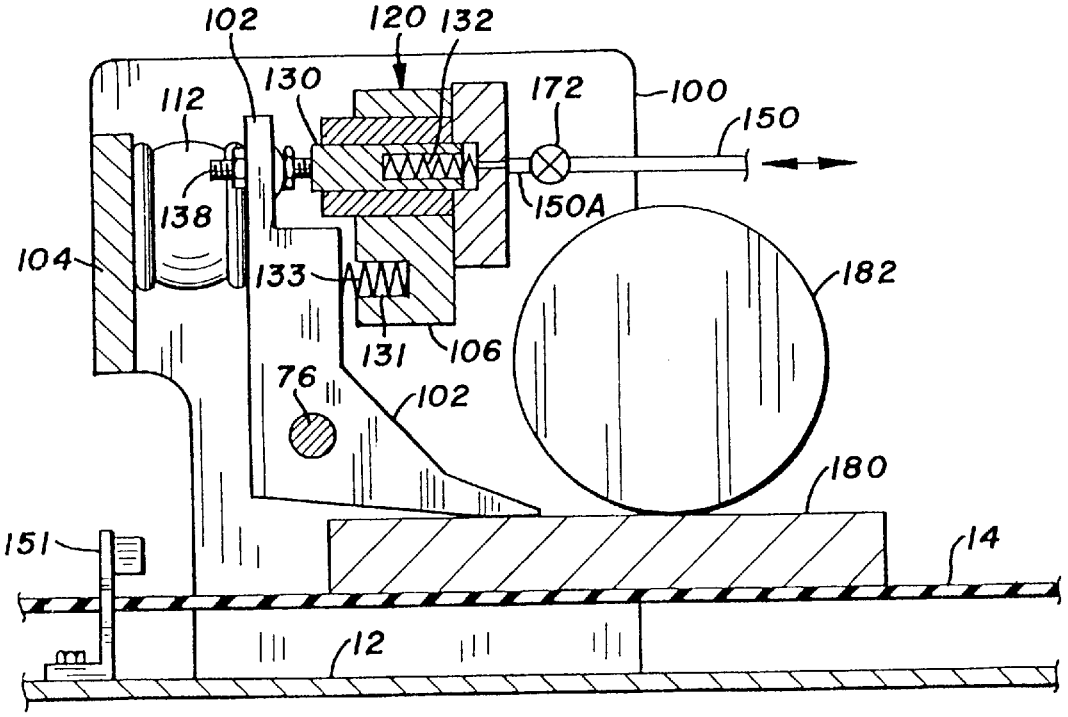
FIG. 8 is an end view of the pressure shoe assembly with the pressure shoe lowered onto the workpiece with a predetermined pressure, and locked into place by the hydraulically lockable work support.

Referring to FIG. 8, once workpiece 180 is advanced under pressure shoe 102, as sensed by sensor 151, controller 162 will respond by opening pneumatic valve 166 via control line 167. Pneumatic pressure will be applied via valve 166 such that bellows 112 is selectively inflated to correspondingly urge pressure shoe 102 against workpiece 180. Air will continue to be fed to bellows 112 until a predetermined pressure is attained, as sensed by pneumatic pressure sensor 169 and communicated to controller 162 via line 170. Next, after a predetermined period of time, controller 162 causes hydraulic valve 172 to open, thus causing hydraulic locking device 120 to lock the position of piston 130, and thus limit further rotation of shoe 102. Workpiece 180 is continued to be advanced under both working head 182 and pressure shoe 102 while shoe 102 and piston 130 remain locked in place.

METHOD OF OPERATION

A. Pressure Shoe

Figure 9:
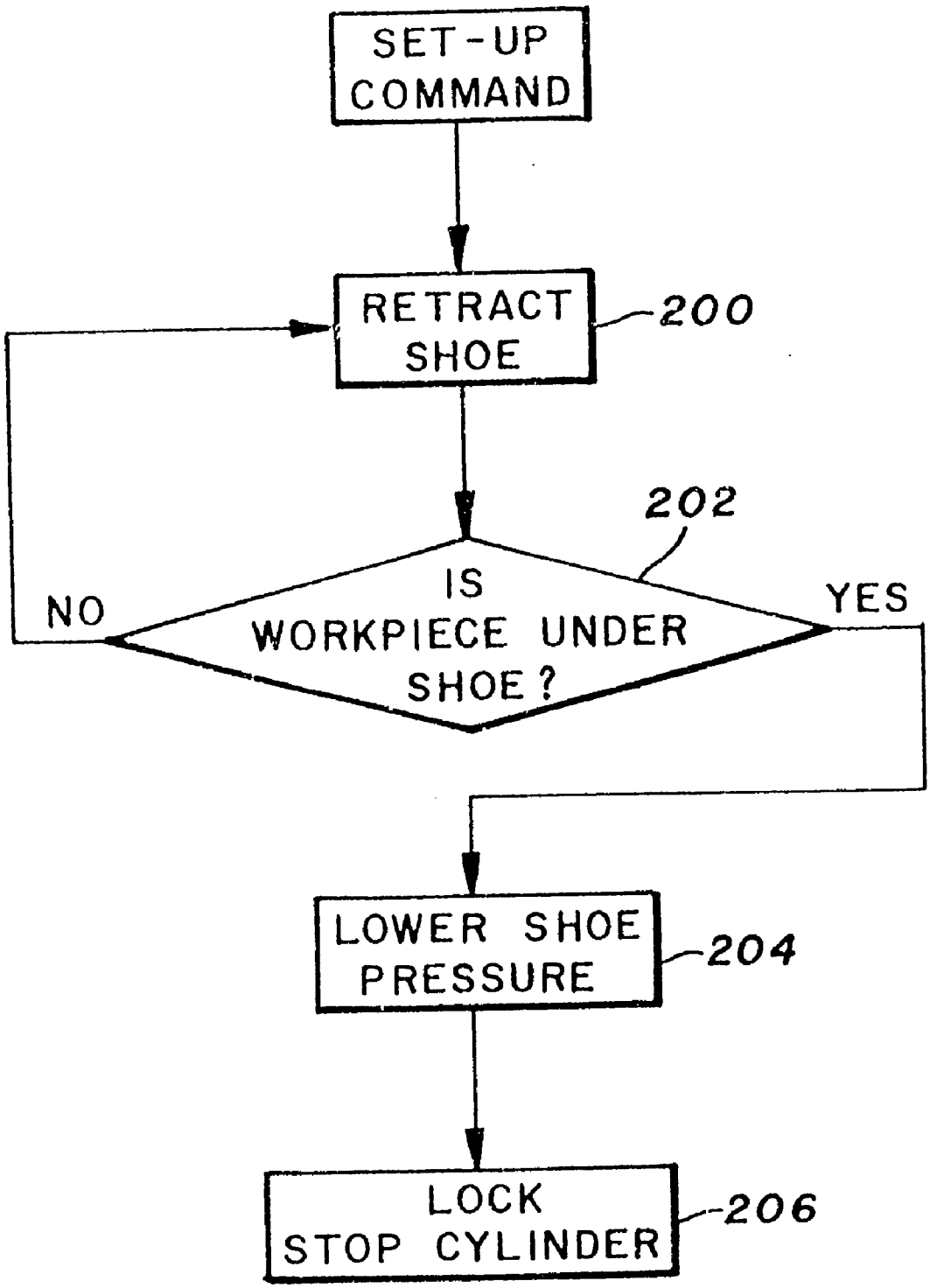
FIG. 9 is a flow diagram of the method performed during a setup procedure.

Referring to FIG. 9, the method that the present invention performs setup of the pressure shoe is summarized in a flow diagram. At step 200, microprocessor controller 162 insures that pneumatic bellows 112 is deflated and spring 133 places pressure shoe 102 into a retracted position. Stated briefly, the air pressure is dropped and the spring return raises the shoe for the work to pass under the toe of the shoe 102. (See FIG. 7). In step 202, once microprocessor controller 162 determines that a workpiece 180 has been advanced under pressure shoe 102, as sensed by optical sensor 151, microprocessor controller 162 causes pressure shoe 102 to be lowered against a workpiece 180 to a predetermined pressure. The shoe is lowered using pneumatic bellows 112, which inflates due to pneumatic valve 166 being opened by the controller 162. Briefly, the locking stop member 130, which extends by virtue of spring pressure, extends to follow the shoe. Air pressure pushes the shoe against the workpiece to a fixed level of deflection as the work passes. Next, at step 206, microprocessor controller 162 locks piston 130 of locking device 120, using hydraulic valve 172. Briefly, the locking stop is locked in place. At this point, a gauge may be employed to measure the sanded wood surface. Microprocessor controller 162 continues to monitor sensor 151 until it is determined that workpiece 180 has been advanced by conveyor 14 past shoe 102. Piston 130 remains hydraulically locked and is the stop limit for shoe 102 during the operation for which the setup is being undertaken.

Using the apparatus and method of the present invention, the pressure shoe will be precisely and accurately lowered into place upon a workpiece. The motion limiting piston 130 for shoe 102 is adjusted relative to the pressure head apex, and is adjusted to take into consideration the natural spring of the various components of the surfacing machine. The entire setup procedure is controlled remote from the machine at an operator's console (not shown) at which microprocessor controller 162 is located. The overall shoe setup is quick to accomplish and requires no manual intervention by the operator. Rather, the pressure shoe will automatically come into contact with, and apply pressure to the workpiece, with the shoe motion limiting piston 130 being locked into place as the workpiece is being advanced. The workpiece will be assured a smooth surface due to consistent feeding throughout the machining process, since the workpiece is not caused to hesitate or move intermittently resulting in a rippled or washboard workpiece surface.

Figure 10:
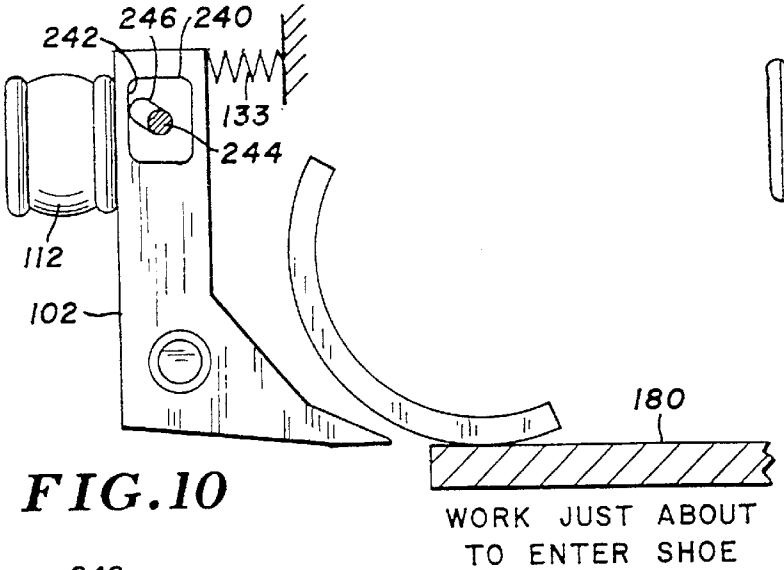
FIG. 10 is an end view of a pressure shoe with a travel limiting stop according to an alternative preferred embodiment of the invention, wherein the pressure shoe is shown having a rotatable locking cam, the shoe shown in its set position as the workpiece is just about to enter under the pressure shoe.

Referring now to FIG. 10, an alterative embodiment travel limit stop of locking mechanism 120 is shown. Referring to FIG. 10, the hydraulically operated locking mechanism 120 is replaced by an eccentric shoe travel or stop limit device. This device is comprised of a cam selectively rotated to engage an inner wall of an opening provided through the upper end of pressure shoe 102. Specifically, the upper end of shoe 102 has a rectangular opening 240 with a rear edge 242. Bolt 244 having two similar cam portions 246—246 is positioned within opening 240, with one cam 246 being positioned at each end of bolt 244, as shown. Bolt 244 extends through frame plate 100, the frame serving as a leverage point. To set the travel limit device, as shown in FIG. 10, after shoe 102 is lowered against workpiece 180 to a predetermined pressure as previously described, bolt 244 is rotated until the lobe of cam 246 engages the forward surface 242 of opening 240. In this locked position, shoe 102 cannot be rotated further clockwise from this position. Rotation of bolt 244 is performed hydraulically, and is controlled remotely at the operator's console.

Figure 11:
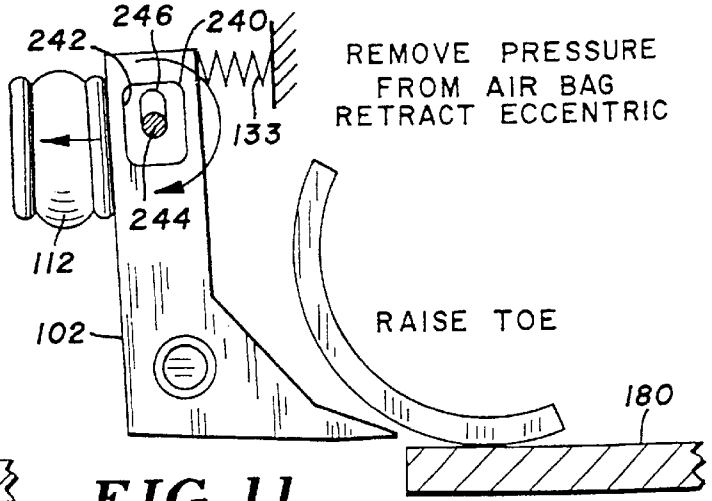
FIG. 11 is an end view illustrating the pressure shoe in a retracted position with the cam travel limiting stop retracted from a locked position by rotating an eccentric within a shoe opening before the workpiece enters under the shoe.

To set the stop limit prior to a workpiece being advanced under shoe 102, bolt 244 is rotated clockwise to remove cam 246 from surface 242 (FIG. 11). Pneumatic bellows 112 is then deflated, wherein spring 133 retracts shoe 102 as previously described.

Figure 12:
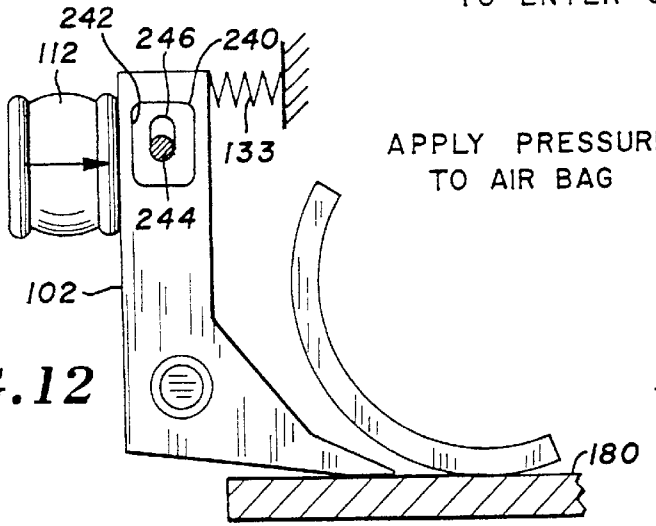
FIG. 12 is an end view illustrating the workpiece advanced under the pressure shoe, and with the pressure shoe pneumatically advanced to urge against the workpiece, wherein the shoe is in an unlocked position.
Figure 15:
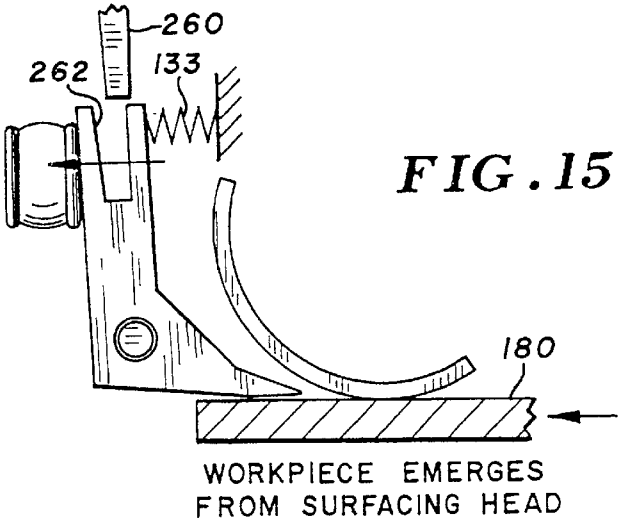
FIG. 15 is an end view of the wedge first removed from the pressure shoe notch, and the pressure shoe retracted before the workpiece emerges from the surfacing head and advanced under the pressure shoe.

Referring to FIG. 12, shoe 102 is lowered by bellows 112 against workpiece 180 to a predetermined pressure, as previously described, wherein cam 246 remains separated from surface 242.

Figure 13:
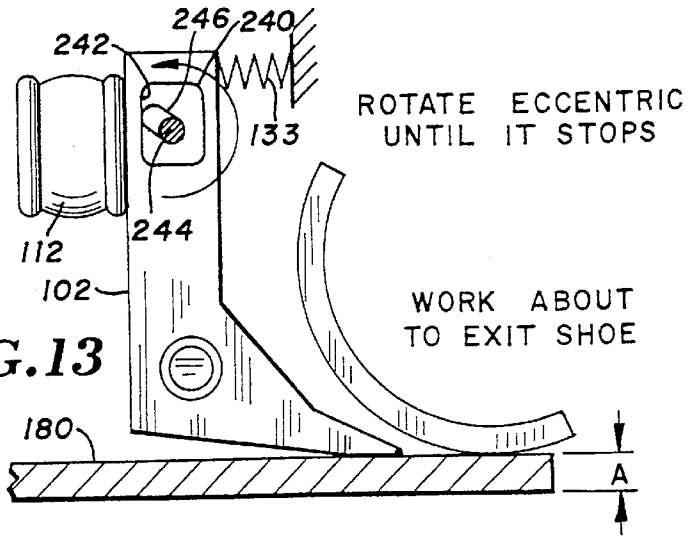
FIG. 13 is an end view of the pressure shoe with the eccentric travel limiting stop rotated counter-clockwise into a locked position to secure the shoe in the setup position.

Finally, as shown in FIG. 13, cam 246 is rotated counterclockwise until it engages surface 242. As such, shoe 102 cannot be rotated further clockwise as the workpiece is advanced thereunder. The rotation of bolt 244 is performed automatically using conventional hydraulic procedures. As a result, a minimum setting "A" is always maintained.

Figure 17:
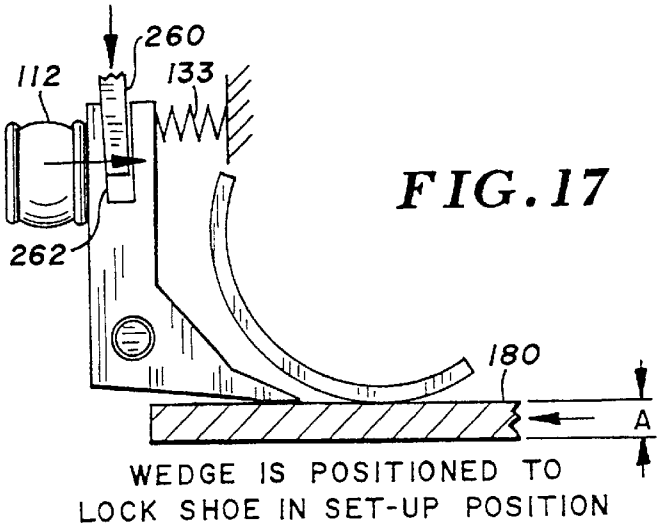
FIG. 17 is a view of the wedge lowered into the shoe notch to lock the shoe into place in its setup position.
Figure 14:
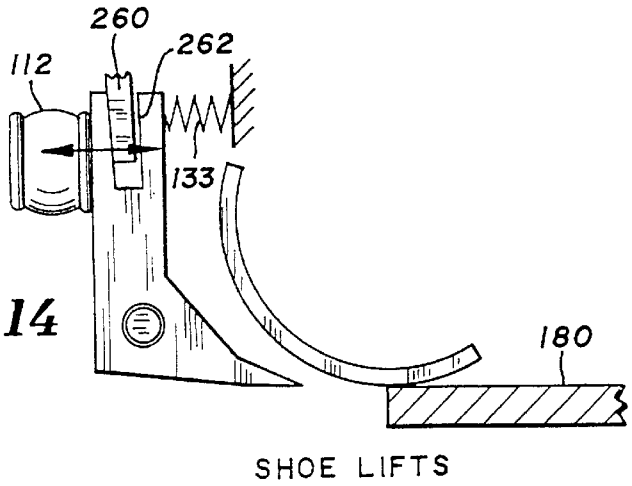
FIG. 14 is an end view of a pressure shoe with yet another alternative preferred embodiment of an automatically operable travel limiting stop comprised of a wedge which can be selectively secured into a pressure shoe notch.
Figure 16:
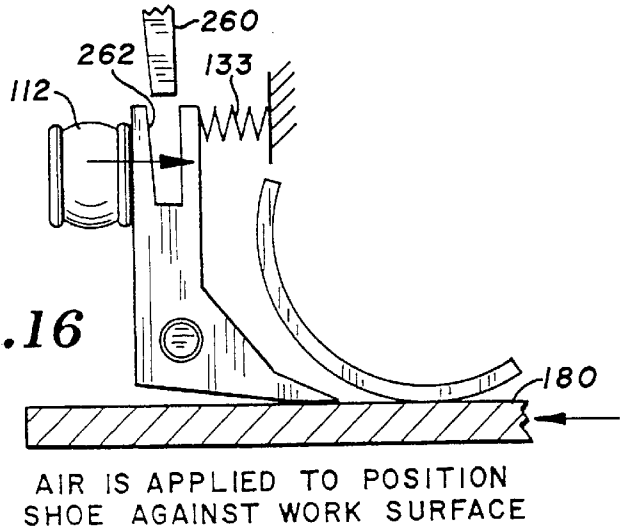
FIG. 16 is a view of the pressure shoe pneumatically lowered against the workpiece.

Referring now to FIG. 14, a further alternative embodiment of locking mechanism 120 is shown. As shown in FIGS. 14–17, a wedge 260 is shown to be selectively positioned within and removed from a notch 262 defined in the upper end of shoe 102. This wedge is removed from the shoe prior to retracting, and reinserted after the shoe has been advanced against the workpiece to a predetermined pressure. The wedge is operatively secured to the machine frame, and inserted into the notch to achieve a locked position. Inserting and removing wedge 260 is done using conventional hydraulic procedures. As shown in FIGS. 14 and 17, a small spacing forward of wedge 260 is realized to allow shoe 102 to retract slightly if over-sized workpieces travel thereunder. The rear surface of wedge 260 is in abutment with notch 262 to limit further clockwise rotation of shoe 102 once set. Thus, a minimum setting "A" is always maintained, as shown.

In summary, a means for automatically setting a shoe stop limit for limiting shoe travel is disclosed. The shoe is first advanced against the workpiece to a predetermined pressure thus taking into account the natural spring of various machine components, including the elastic covering of the surfacing head which deforms and wears over time. Once this predetermined pressure has been achieved, the travel limit stop is automatically and hydraulically locked into place, and it remains so locked. While a hydraulically operated work support manufactured by Vektek Corporation has been described in the preferred embodiment, other embodiments disclosed show alterative ways of locking the stop limit into place. The entire travel limit adjustment procedure is performed quickly, and accurately, with setup being automatically performed by a programmed controller located at an operator's console.

B. Additional Features for Pressure Shoes

In an additional embodiment of the present invention, the shoes may be provided with means to accomplish utilization of the shoes as a workpiece measuring device. In this arrangement, the shoes will be arranged to contact the surface of the workpiece, and the position of the shoe will be sensed and converted into a dimension representing board thickness. Such information is then provided as an input to a controller utilized to adjust the conveyor height or work station dimension. As an additional feature, a comparison of the position of the infeed shoe relative to the position of the outfeed shoe can be utilized to indicate the actual amount of stock removed at each head. When the position of the infeed shoe is related to the head position, abrasive belt wear may be determined.

In certain instances, it may be desirable to provide the control mechanism with predetermined limits on motion in order to inform the operator if a new setup procedure is indicated. Other valuable utilization of this data is also possible.

C. Head Position and Drive Control Operation

As indicated hereinabove, a typical arrangement of components includes a tandemly or serially arranged grouping of surfacing heads. With attention being directed to FIG. 18 of the drawings, a system generally designated 270 is illustrated which incorporates a serially or tandemly arranged trio of heads 272, 274 and 276. Each of these is a drum head and is positioned adjacent to and in superimposed relationship to conveyor belt 278. Each of the heads carries an orbiting wide belt in operative relationship thereon, particularly as illustrated at 272A, 274A and 276A. A drive roll is provided for each of the drum heads such as at 272B, 274B and 276B. Each drive roll is driven by a belt drive arrangement from individual motors as at 272C, 274C and 276C, with a drive belt, preferably a timing belt, with suitable pulleys being utilized to accomplish the coupling. Each of the drum heads and associated drive rolls is coupled to a rearwardly disposed support frame, as shown at 272D, 274D and 276D.

Figure 18:
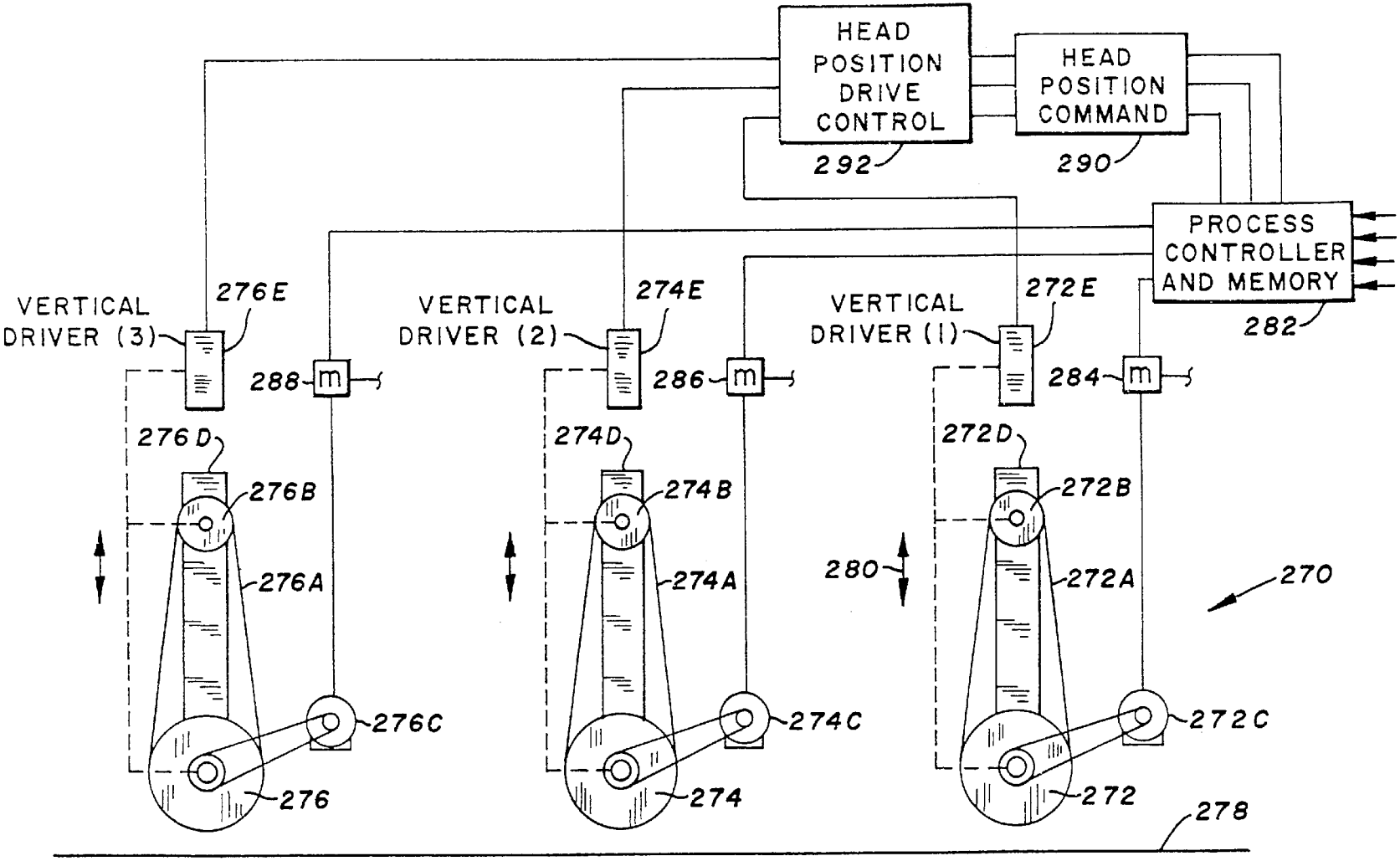
FIG. 18 is a side view of an abrasive finishing machine with the side panels and other portions removed for purposes of clarity, showing the arrangement of the command and control features for adjustably positioning heads with respect to the surface of the work, and further showing, in block diagram form and schematically, the arrangement of the memory, head position command, and head position drive control features of the present invention.

As is further illustrated in FIG. 18, a vertical driver is shown coupled to each of the individual frame members 272D, 274D and 276D by a phantom coupling line. Vertical driver 272E is, as indicated, operatively coupled to the system incorporating drum head 272, while drivers 274E and 276E are coupled to frame 274D and 276D respectively, for controllably positioning drum heads 274 and 276 respectively. Double-headed arrows such as at 280 illustrate the manner in which the respective frames 272D, 274D and 276D are moved. Vertical motion of the frames will, in each instance, achieve a controllable positioning of the individual drum heads to which they are coupled.

With attention now being directed to the memory, head position command, and head position drive control, the following is illustrative. Memory 282 is utilized to receive and retain empirical data relative to machine operation and performance. The memory is designed to maintain and control motor loads as well as motor speed so as to achieve uniform product output. Memory 282 stores information pertinent to normally encountered machine loading of the individual motors driving the abrasive belts. A further set of inputs to the memory 282 is obtained from load meters 284, 286 and 288, with each load meter being designed to deliver a motor load signal indicative of the loading of the individual motors 272C, 274C and 276C respectively. In response to motor loads which are either unusually high or unusually low, head position command 290 delivers a signal to head position drive control 292 for controllably and adjustably repositioning an individual head so as to achieve operation within normally and demonstratively anticipated operational limits. By way of example, belt 272A is of a relatively coarse grit, for example, #36, while belt 274A is of a medium grit such as #50 grit. Belt 276A is of a fine grit, such as #80 grit, a grit which is suitable for many final stages in finishing operations.

By way of example, if a workpiece being transported on conveyor 278 has a dimensional thickness which is within the upper range of, but within tolerances, the load on motor 272C will increase. In order to provide for an adequate amount of removal from the workpiece, the vertical driver 272E will be activated and head 272 will be raised an amount suitable to permit removal of an adequate amount of material, but not as much as would otherwise normally be removed at the first station. Thereafter, the work station defined by drum 274 may be adjustably positioned so as to remove the appropriate balance of material so as to permit passage of an appropriately dimensioned workpiece to the final work station at drum 276, which carries the finest grit or abrasive mineral size of the three. By spreading the work load for proper dimensioning of the workpiece between drum heads 272 and 274, a number of advantages can arise. Initially, the apparatus is capable of providing sufficient material removal between drum heads 272 and 274 so as to achieve proper final dimensioning of the workpiece. Additionally, the overall system as shown at 270 benefits by avoiding overloading of individual abrasive belts such as belt 272A, and thereby shortening the expected or anticipated lifetime of that belt. By providing a sharing of the work necessary for an individual workpiece between belts 272A and 274A, longer belt life will be achieved. Also, belt loading with particulate will be reduced, thereby further improving the performance of the system.

By way of a still further example, the workpiece has a desired thickness dimension at the outfeed of ¾th inch, the incoming workpieces, considering tolerances, will typically have a thickness ranging from between ⅛th inch and 8 inches. Whenever the workpiece is at the lower end of the acceptable tolerances, very little stock removal is required and this removal will typically be entirely undertaken by belt 272A traveling over drum head 272. Little, if any, additional stock removal occurs during contact with belt 274A, and scratch patterns present on the workpiece will include scratch patterns developed by the #36 coarse grit of belt 272A until replaced by patterns of the #50 medium grit as on belt 274A. Typically, as the workpiece comes into contact with belt 276A, the system can remove existing medium scratch pattern and replace it with a pattern created by the finer grit on the belt 276A without permitting scratch patterns created by the coarser grits to remain.

As a further advantage of the system operation of system 270, it will be noted that the tolerances for workpieces entering the system may be expanded because of the ability of the individual drum heads to provide appropriate treatment and stock removal at each station. The stock removal is undertaken in such a way that the finest grit which is present on the final station is fully able and capable of removing scratch patterns present on the surface of the workpiece and leave an acceptable degree of surface roughness created by the fine grit available at the final station.

In an automatic system, the setup is determined from the output requirements, including the final output scratch pattern and the total stock removal required. The operator or setup person works through the system in a reverse direction to determine the amount of stock removed by each head and the abrasive grit required to perform the task. The operator determines if it is within the capability of the machine to perform the task and provide an acceptable finish at the required stock removal rate. This is based upon the number of heads, the feed rate possible, and the horsepower available. The power requirements are established so that the mechanism is not required to operate at its maximum capability unless that is an absolute requirement of the setup. In other words, the goal is not to use all of the stock removal capability or capacity of the system, but rather to extend the life of the abrasive belt and other components by taking off the least amount of material required while controlling the process to maintain a desired amount of stock removal for each head. Variables, including conveyor belt compression, machine flex, wear of abrasive belt, compression of the drum covering, etc. are all subject to compensation or adjustment by the system of the present invention. Input is not required for each of these variables for either manual or automatic operation. The setup may be stored and retrieved from a computer or PLC for an automatic system, or undertaken manually on a less complex system.

D. Dimensioning

Gauging devices in the form of pressure shoes or pinch rolls, located at the outfeed of dimensioning heads, accurately sense the thickness of the workpiece while allowing for abrasive belt wear, conveyor belt wear and compression, condition and wear of the drum, heat, conveyor belt speed, and other factors which vary in time. With the information provided by these gauging devices, the operator determines the condition of the machine at each stage of the process and knows that the optimal process is proceeding as intended.

In dimensional finishing with any abrasive belt or planer head combination, the goal is to remove all of the previous scratch or surface damage uniformly across the width of the workpiece. "When this is achieved, then a qualified scratch at that grit is present on the workpiece. As an example, a #120 grit qualified scratch will have removed all coarser scratches than those produced on a #120-grit abrasive. Abrasive belt grits are sequenced to assure that the previous scratch can be removed. Typically, only one grit size should be skipped in any grit sequence.

Removing more material than is necessary wastes stock, energy, dust collection capacity, and abrasive belt life. One goal of widebelt finishing is to achieve the final desired qualified scratch with the least amount of stock removal. Coarse abrasive grits are excellent at rapid stock removal, but produce coarse scratches which must be progressively removed down to the preferred final scratch pattern. Fine abrasive grits cannot remove stock at a high rate or depth, but produce finer finishes which require less work to replace.

Knife planing is similar to abrasive planing in that it produces visible and subsurface damage which must be removed by further abrasive processing to produce the target surface finish. Planer knives, both new and worn, crush some subsurface cells as well as remove others. The crushed cells may return to normal size when applying aqueous or solvent based finishes, or even with humidity variations in time. This produces a very undesirable washboard surface. Removing 0.007 to 0.015 inches or more material following planing is recommended to remove this surface and subsurface planing damage.

E. Machine Setup

The system of the present invention automatically sets the gauging shoes and/or rolls to the exact thickness of the workpiece as the workpiece passes that device. The shoes are locked by air pressure which may be duplicated at any time in the future for repeatable, predictable performance. An automatic stop is set as the gauging device references the workpiece surface to set the shoes and roll accurately and precisely to the finished surface.

Shoes are set exactly to the thickness of the material leaving the finishing head. Setting shoes on the system of the present invention is accomplished by lowering the shoes directly against the newly finished surface, under a repeatable pressure, and with the shoes then being locked in that position. Dial indicators or other gauges provide the measurement of the workpiece thickness for setting and controlling the stock removal, aligning the machine components, and providing diagnostic tools for evaluating the condition of the machine.

Operating the system causes each shoe and gauging roll 317 to reset and wait for a workpiece to move past that gauging device. The gauging device will automatically set on the surface which passes, and lock itself at that setting. The shoe is free to relieve above that surface under the preset air pressure as the abrasive or knives in the finishing head begin to wear. After sufficient wear, the overall adjusting function is rerun and the new set point is found. The finishing heads will then be readjusted to achieve the stock removal specified for each head, providing complete control of the finishing process.

The outfeed gauging roll positive stop is set at 0.010 inches below the target outfeed thickness. This limits the distance that the gauging roll 317 must be lifted by the workpiece. It also limits impact which could cause potential surface imperfections. The outfeed positive stop is set toward the lower end of the adjustment for that abrasive head to assure that all other heads can be adjusted within their adjustment limits.

There may be cosmetic surfacing heads beyond the last dimensioning head and gauging device, such as orbital heads or brushes. These heads do not remove measurable material. The measurement of the last gauging head may be used to facilitate setups of these cosmetic heads.

A test workpiece is selected that is flat and has uniform thickness for setup purposes. Particle board strips with surface debris and other irregularities removed work well for this task. The workpiece thickness is measured. Set the table opening, such as by a handwheel on the side of the machine, to this measurement.

The abrasive belt is adjusted out of contact with the workpiece or alternatively, the belts are removed. Prior to running the conveyor belt, the gauge function is run so that each gauging device is lowered to its lowest level. The lowest point on the outfeed gauging device is noted. The machine is started and a test workpiece is run through the machine. The outfeed gauging device normally reads about 0.010 inches above the minimum reading noted. The gauging devices are then set.

The dial indicator on each gauging device is reset to zero representing the zero reference plane. All future adjustments for the operation or run will be made relative to this level. Over a production run, changes are normally not required to the zero reference plane.

F. Establishing Gauge Target Readings

Stock removal amounts are established for each head in the gauging reading chart, it being observed that removal of more stock than is necessary to achieve the preferred finish wastes stock, energy, dust collection capacity, and abrasive belt life. Minimum stock removal required to remove previous scratch patterns is desired.

Desired or target stock removal amounts indicate the reading for each dial indicator on the individual measuring devices at the outfeed of each work station. When these values are achieved during a run, then each abrasive head is achieving the stock removal desired and specified.

G. Memory Function

As a given machine is rendered operational, it produces optimum abrasive life while producing the desired qualified scratch from each head. As abrasive belts wear, and as other components of the system age, other compensations must be undertaken. By utilization of the empirical data learned from machine operation, the empirical data may be entered into the memory in order to provide for automatic readjustment of the system as it operates. For example, as abrasive belts wear, the gauging device will rise accordingly as the finished workpiece passes the individual head. The memory system of the present invention utilizing empirical data, detects when the dial indicator deviation for any head approaches the operational guidelines, thereby moving the head closer to the conveyor belt, and thereby achieving an adjustment which renders the operation more consistent.

H. Diagnostic Information

In accordance with the present invention, information is provided with respect to the operating condition of the machine. The conditions for which adjustment or accommodation may be achieved include that resulting from excessive belt usage, inability to hold finished workpiece size, and an inability to provide the desired workpiece finish. A feature of the present invention provides for a means to assure that the gauging devices are level across the width of the machine when workpieces pass therebelow, with the gauging devices measuring on a horizontal plane parallel to the plane of the conveyor belt across the entire width of the machine. Furthermore, the system provides for maintaining the finishing heads level across the width of the machine. For example, one of the features of the operation of the present invention is to assure that the axis of the roller of gauge 317 is horizontal and parallel to the surface of the conveyor belt flight.

I. Operator Input

Figure 19:
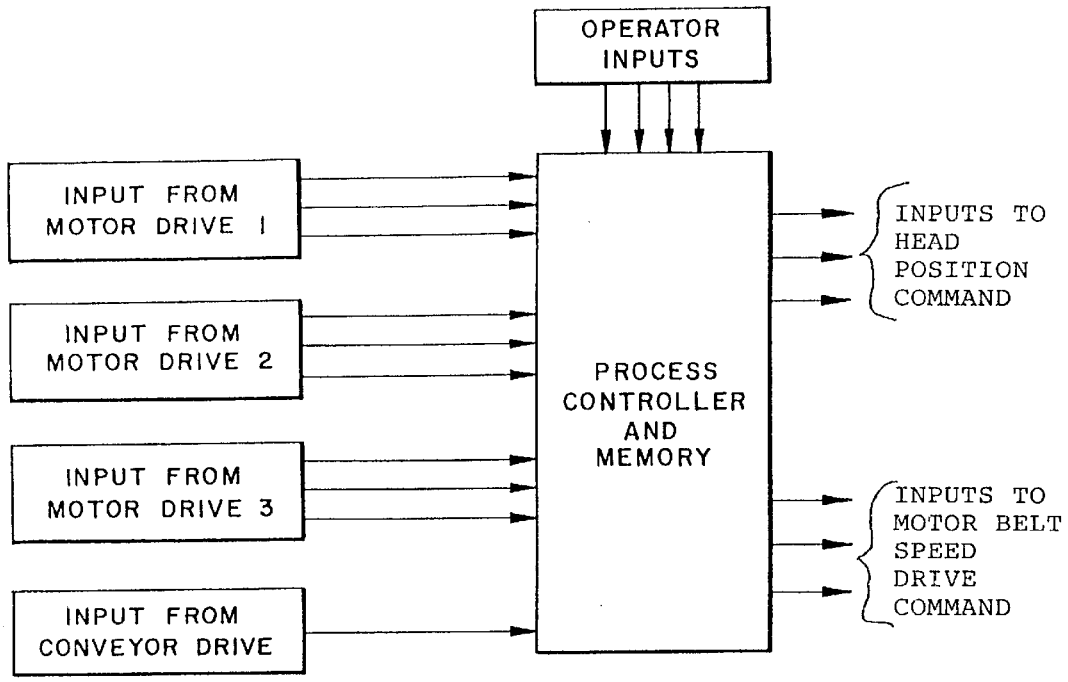
FIG. 19 is a block diagram showing the arrangement of operator inputs and motor drive inputs with respect to a process controller and memory.
Figure 20:
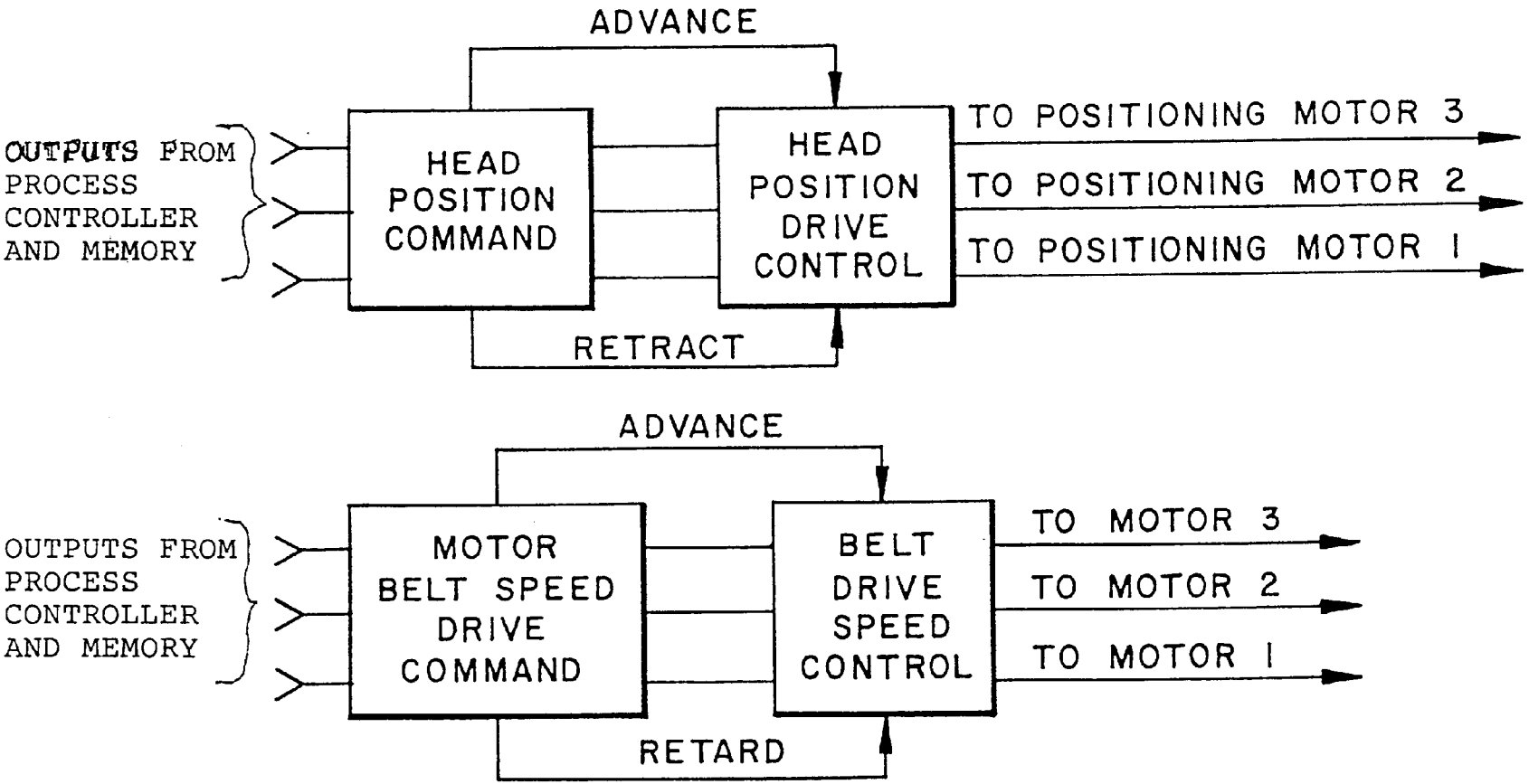
FIG. 20 is a block diagram illustrating the manner in which the head position and motor speed drive commands function with respect to the individual positioning and drive motors respectively.

With attention now being directed to FIG. 19 of the drawings, it will be seen that the operator inputs to the process controller are provided for each of the individual stations, with the operator inputs including such parameters as the following:

(a) wood variety;

(b) normal motor load for each station including tolerances;

(c) comparative motor loading including tolerances;

(d) variations due to compression or other alteration of resiliency of drum surfacing rubber;

(e) conveyor belt compression;

(f) flexure of machine; and (g) abrasive belt wear.

Figure 21:
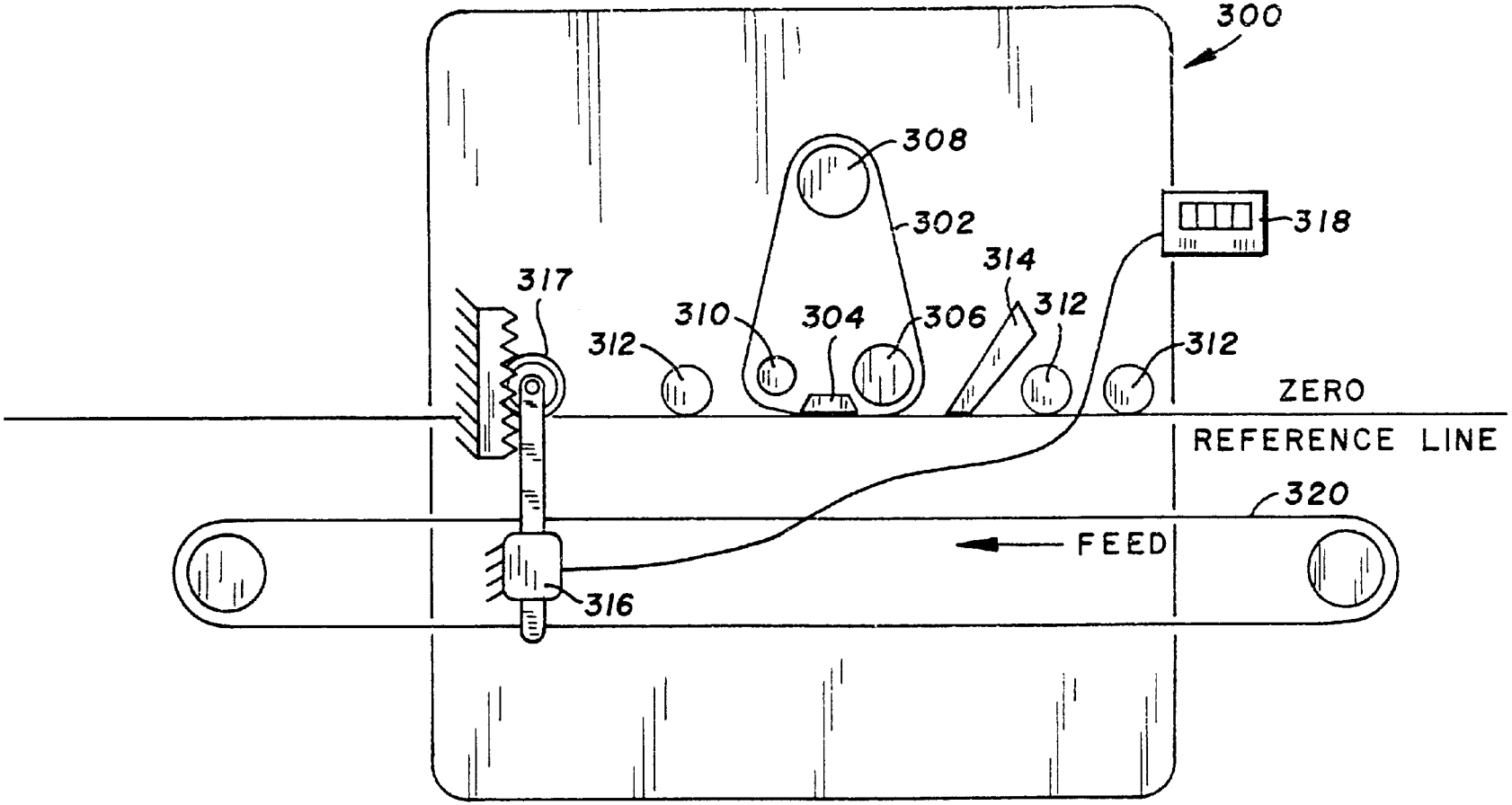
FIG. 21 is a side elevational view illustrating, schematically, the utilization of a workpiece thickness determining gauge or datum reference for a wide belt sanding station incorporating a platen head, with the workpiece thickness gauge determining the thickness of each workpiece at the outfeed of each working station, thereby permitting precise measurement of the thickness of each workpiece as it passes through each stage of the system, thereby permitting optimization of the overall process being performed on the workpiece.

With attention being directed to FIG. 21 of the drawings, the system generally designated 300 includes an orbiting endless belt abrader 302 of the platen head type, with the platen being illustrated at 304. Drive cylinder or drum 306 is employed along with idlers 308 and 310. Pinch rolls are illustrated as at 312—312 with a hold-down shoe being shown at 314. A zero reference line is established by gauge member 316, with a readout being available from meter 318. Work is carried in the feed direction, as indicated, along conveyor 320 as is conventional in the art.

In this arrangement, once the zero reference line is established, the features described hereinabove with respect to the systems illustrated in FIGS. 5 through 21 will function accordingly. Control of the overall system is achieved by utilizing position control as well as motor control in accordance with the disclosure of the systems illustrated in FIGS. 5–21 above.

For instance, while the adjustment procedure, and the mechanisms used for accomplishing setup, has been discussed in reference to one pressure shoe, it is to be recognized by those skilled in the art that such devices and procedures is preferably implemented with all of the pressure shoes provided in machine 10. Further, while the present invention has been disclosed with reference to a pressure shoe, it is also to be recognized by one skilled in the art that pinch rolls, pressure rollers or other suitable pressure devices for urging a workpiece against the conveyor as it is advanced under a working head is suitable for use as well. These rollers are typically vertically adjustable using pneumatic devices, and capable of being locked into place using the hydraulically operated locking device as disclosed. Accordingly, limitation to a pressure shoe is not to be inferred.

This invention has been described herein in considerable detail in order to comply with the Patent Statutes and to provide those skilled in the art with the information needed to apply the novel principles and to construct and use the same. However, it is to be understood that the invention can be carried out by specifically different equipment and devices, and that various modifications, both as to the equipment details and operating procedures, can be accomplished without departing from the scope of the invention itself.

What is claimed is:

1. A surfacing machine for treating workpieces, comprising:

a frame;

conveyor means having a surface for supporting and advancing said workpieces;

at least one workpiece finishing means having a surface opposed to the surface of said conveyor means and being coupled to said frame;

at least one working station being defined by the opposed surfaces of said at least one workpiece finishing means and said conveyor means;

said workpieces having a first and second surface, said first surface of said workpieces being in contact with and opposed to said surface of at least one workpiece finishing means, said second surface of said workpieces being in contact with and opposed to said surface of said conveyor means;

said at least one workpiece finishing means treating and finishing said first surface of said workpieces advanced therepast, and including means for contacting said first surface of said workpiece;

pressure shoe means pivotally coupled to said frame proximate each said working station for applying downward pressure to said workpieces as they pass upon said conveyor means through said working station;

adjustable stop limit means and a retracting spring means coupled to said frame for limiting a rocking movement of said pressure shoe means relative to said workpiece;

first control means coupled to said stop limit means for selectively altering a position of said adjustable stop limit means such that said pressure shoe means can be selectively setup to accommodate a particular said workpiece;

second control means including:

(i) a data storage memory having means for receiving and retaining data representing workpiece dimensions, workpiece configuration, workpiece properties, and acceptable operating parameters experienced by said workpiece finishing means while workpieces having such dimensions, configurations and properties are being treated within said at least one work station; and (ii) means for simultaneously selectively and adjustably controlling the operating parameters of a motion and a vertical position of said workpiece finishing means so as to enable the workpiece finishing means contacting the workpiece to perform within acceptable operating parameters, to adjust during the treatment of workpieces to at least one of the workpieces dimensions, configurations and properties as received and retained by the data storage memory, and to assure constant forward motion of the workpiece through each working station of said surfacing machine following initial contact of each workpiece with said pressure shoe.

2. The machine as specified in claim 1 wherein said adjustable stop limit means further includes locking means for selectively locking said adjustable stop limit means in place after adjustment by said control means.

3. The machine as specified in claim 2 wherein said pressure shoe means comprises a pressure shoe having an upper end with a notch defined therein, and said locking means is coupled to said main frame and comprises a protrusion which can be selectively inserted into said notch to limit the pivoting of said pressure shoe.

4. The machine as specified in claim 1 wherein said first and second control means are operatively coupled to, but positioned remote from, said adjustable stop limit means for remotely controlling operation thereof.

5. The machine as specified in claim 1 wherein said pressure shoe means comprises a pressure shoe, and said adjustable stop limit means comprises a piston means having a selectively extendable piston member which restricts the pivoting of said pressure shoe.

6. The machine as specified in claim 5 wherein said piston means further comprises a clamping means for selectively locking said piston member in place after adjustment.

7. The machine as specified in claim 1 wherein said pressure shoe means comprises a pressure shoe having an upper end, and said adjustable stop limit means comprises cam means disposed through said upper end for selectively restricting the pivoting of said pressure shoe.

8. The machine as specified in claim 7 wherein said pressure shoe upper end has an opening defined therethrough, and said cam means has a rotatable cam member coupled to said frame and within said opening, whereby rotation of said cam member adjusts a downward pivot limit of said pressure shoe.

9. The surfacing machine as specified in claim 1 wherein said at least one workpiece finishing means comprises:

guide means for receiving and guiding an endless abrasive belt with an abrasive coated outer surface about a predetermined path while trained about a plurality of cylindrical drums having axes of predetermined length and with said cylindrical drums being arranged along spaced apart parallel disposed axes; and drive means for drivably rotating at least one said cylindrical drums.

10. The surfacing machine as defined in claim 1 being particularly characterized in that said at least one workpiece finishing means comprises a drum head.

11. The surfacing machine as defined in claim 1 being particularly characterized in that said at least one workpiece finishing means comprises a plurality of serially arranged work stations.

12. The surfacing machine as defined in claim 11 wherein said at least one workpiece finishing means comprises three workpiece finishing means further comprising three serially arranged work stations, with each successive work station employing a finer abrasive grit than its preceding work station.

13. The surfacing machine as defined in claim 1 wherein said data storage memory includes identity of characteristics of wood stock, workpiece thickness at output relative to thickness at input, and properties of abrasive mineral.

14. A method of setting up an apparatus having:

(a) a frame;

(b) at least one workpiece finishing means having a surface, said workpiece finishing means coupled to said frame for finishing said workpieces advanced therepast;

(c) conveyor means being defined by a conveyor belt, said conveyor belt having a surface for supporting workpieces, said workpieces having surfaces in contact with and opposed to said workpiece finishing means and said conveyor belt, said surface of said conveyor belt being opposed to said surface of said at least one workpiece finishing means defining a working station;

(d) pressure shoe means pivotally coupled to said frame proximate said working station for applying downward pressure to said workpieces as they pass upon said conveyor means through said working station;

(e) adjustable shoe stop limit means and a retracting spring means coupled to said frame for limiting a rocking movement of said pressure show means relative to said workpiece; and (f) control means coupled to said stop limit means for selectively altering a position of said adjustable stop limit means such that said pressure shoe means can be selectively setup to accommodate and adjust during the treatment of a particular said workpiece through controlling parameters dependent upon workpiece dimensions, workpiece configuration, and workpiece properties;

comprising the steps of:

i) inserting a workpiece into said working station and below said pressure shoe means ii) lowering said pressure shoe means to a first position onto said workpiece to a predetermined pressure and iii) adjusting a position of said stop limit means using said control means dependent upon said dimension, configuration and properties of said workpiece such that said stop limit means restricts pivoting of said pressure shoe means from said first position wherein the position of said stop limit means, as selected, provides for continuous motion of said workpiece through said surfacing machine.

15. The method as specified in claim 14 further comprising the step of locking said stop limit means in place after adjustment thereof.

16. A method of treating workpieces, comprising:

placing said workpieces upon a conveyor means;

pivoting against said workpieces at least one pressure shoe means, said at least one pressure shoe means having an adjustable stop limit means and a retracting spring means limiting a rocking movement of said pressure shoe means relative to said workpieces, said adjustable stop limit means being controlled by a first and second control means;

selectively altering a position of said adjustable stop limit means such that said pressure shoe means can be selectively setup to accommodate a particular said workpiece by said first control means;

treating and finishing said workpieces utilizing at least one workpiece finishing means;

receiving and retaining data representing workpiece properties such as but not limited to dimensions, configurations and properties by said second control means comprising a data storage memory while workpieces are being treated and finished by said at least one workpiece finishing means; and adjusting in-situ said adjustable stop limit means while workpieces are being treated and finished by said at least one workpiece finishing means.

17. The method of claim 16 further comprising the step of selectively locking said adjustable stop limit means in place after adjustment by said first control means.

18. The method as defined in claim 16 wherein at least one workpiece finishing means comprises an endless abrasive belt trained about a plurality of cylindrical drums and drive means for drivably rotating at least one said cylindrical drum.

19. A surfacing machine for treating workpieces, comprising:

a frame;

a conveyor means having a surface, said surface supporting and advancing said workpieces through said surfacing machine;

at least one workpiece finishing means having a surface opposed to said surface of said conveyor means and being coupled to said frame such that said workpieces are in contact with and pass between said opposed surfaces whereby said at least one workpiece finishing means treat and finish said workpieces;

at least one pressure shoe means pivotally coupled to said frame and applying pressure to said workpieces against said conveyor means;

adjustable stop limit means and a retracting spring means coupled to said frame for limiting a rocking movement of said at least one pressure shoe means relative to said workpieces;

said adjustable stop limit means being controlled by a control means comprising a first and second control means;

said first control means comprising a data storage memory receiving and retaining data representing workpiece properties such as but not limited to dimensions, configurations and properties while workpieces are entering and being treated and finished by said at least one workpiece finishing means; and said first control means controlling said second control means whereby said second control means adjusts in-situ said adjustable stop limit means while the workpieces are entering and being treated and finished such that the adjustable stop limit means being able to handle variances in said workpiece properties.

* * * * *